US007512460B2

(12) United States Patent
Strosser et al.

(10) Patent No.: US 7,512,460 B2
(45) Date of Patent: Mar. 31, 2009

(54) VALVE CALIBRATION ROUTINE

(75) Inventors: Richard P. Strosser, Akron, PA (US); Christopher A. Foster, Akron, PA (US)

(73) Assignee: CNH America LLC, New Holland, PA (US)

( * ) Notice: Subject to any disclaimer, the term of this patent is extended or adjusted under 35 U.S.C. 154(b) by 229 days.

(21) Appl. No.: 11/711,589

(22) Filed: Feb. 27, 2007

(65) Prior Publication Data

US 2007/0234340 A1 Oct. 4, 2007

Related U.S. Application Data

(60) Provisional application No. 60/777,180, filed on Feb. 27, 2006.

(51) Int. Cl.
*G06D 7/00* (2006.01)

(52) U.S. Cl. ..... 700/282; 73/1.16; 73/1.72; 73/49.8

(58) Field of Classification Search ..... 700/282; 73/1.16–1.36, 49.8
See application file for complete search history.

(56) References Cited

U.S. PATENT DOCUMENTS

| | | | | |
|---|---|---|---|---|
| 6,282,891 | B1 * | 9/2001 | Rockwood | 60/422 |
| 6,341,552 | B1 * | 1/2002 | Potter et al. | 91/433 |
| 6,397,655 | B1 * | 6/2002 | Stephenson | 73/1.72 |
| 6,901,729 | B1 | 6/2005 | Otto et al. | 56/208 |

* cited by examiner

*Primary Examiner*—Jefferey F Harold
*Assistant Examiner*—Sivalingam Sivanesan
(74) *Attorney, Agent, or Firm*—Patrick M. Sheldrake; John William Stader; Michael G. Harms

(57) ABSTRACT

A method for calibrating a proportional solenoid valve used in the propulsion system of a windrower, wherein a programmable control module in connection with a valve and a sensor is programmed as part of an automatic calibration routine for directing test control signals to the valve for causing a predetermined displacement of the hydraulic cylinder, the test control signals having values which vary based on the actual displacement of the hydraulic cylinder as compared with a predetermined value of displacement, and operating the hydraulic cylinder using the test control signal that causes the predetermined displacement of the element. The predetermined displacements correspond to the crack points, or the electrical signal levels at which two ports of interest are just beginning to open to one another from a closed position. Of particular interest are the crack points from the supply pressure port to each of the work ports and from the tank port to each of the work ports.

10 Claims, 39 Drawing Sheets

WR. T2, Propulsion Calibration Software

```
/*
    MODULE:         propulsion.015.c

    DESCRIPTION:    Controls the by-wire propulsion system.

    REVISION HISTORY:
    rps2004dec140801        016 Revised calibration algorithm
  */

#include <stdlib.h>
#include "alarm.h"
#include "bin.h"
#include "canl_out.h"
#include "changes.h"
#include "disppid.h"
#include "ee_vars.h"
#include "fault_log.h"
#include "fnr.h"
#include "fox.h"
#include "gnd_speed.h"
#include "iomap_appl.h"
#include "main.h"
#include "menu.h"
#include "neustart.h"
#include "park_brake.h"
#include "PropSafe.h"
#include "propuls_icntrl.h"
#include "propulsion.h"
#include "Steering_shaft.h"
#include "Steer_wheel.h"
#include "sys_vars.h"
#include "throttle.h"
#include "Timer.h"
#include "trim_switches.h"
#include "warning.h"
#include "wigtest.h"

/****************
    DEFINITIONS
****************/

    // CONSTANT

        #define  ee_PROPULSION_VALVE_FWD_TANK_CRACK_FAULT_MASK      0x01
        #define  ee_PROPULSION_VALVE_FWD_PORT_CRACK_FAULT_MASK      0x02
        #define  ee_PROPULSION_VALVE_REV_TANK_CRACK_FAULT_MASK      0x04
        #define  ee_PROPULSION_VALVE_REV_PORT_CRACK_FAULT_MASK      0x08
        #define  EE_PROPULSION_VALVE_FWD_TANK_CRACK_FAULT_MASK      0x10
        #define  EE_PROPULSION_VALVE_FWD_PORT_CRACK_FAULT_MASK      0x20
        #define  EE_PROPULSION_VALVE_REV_TANK_CRACK_FAULT_MASK      0x40
        #define  EE_PROPULSION_VALVE_REV_PORT_CRACK_FAULT_MASK      0x80
```

PROPULSION.C 23/02/2006 11:22:10

*Fig. 8*

WR, T2, Propulsion Calibration Software

```
        #define  __volts              (signed int)(((float)
        #define  __v_intenths_si      )*359)        // X*10tenths*(10/57)R_divider*(1023/5)AtoD  -> X*359

        #define  _ramptime            _time_b0_ui2scans_sec_f( 1 )        //set timer to aquivalent scans for 100ms
        #define  _initwait            _time_b0_ui2scans_sec_f( 3 )
        #define  _cal_neutral_wait    _time_b0_ui2scans_sec_f( 6 )
        #define  _cal_port_wait       _time_b0_ui2scans_sec_f( 2 )

        #define  _cylinder_pos_INIT   0
        #define  _cylinder_pos_NORM   1

        //Prebuild & Engineering valves

   #ifdef _4mm_ARMATURES //rps2005feb022020
   // Jan 27 2005 - statistical data from Belleville offset by 45 ma for 4mm armatures
        #define  _cal_default_fwd_port_threshold_current_ma_b3_si   current_ma_b3_si( -2186 * _4mm_ARMATURES_GAIN )
        #define  _cal_default_fwd_tank_threshold_current_ma_b3_si   current_ma_b3_si( -1619 * _4mm_ARMATURES_GAIN )
        #define  _cal_default_rev_port_threshold_current_ma_b3_si   current_ma_b3_si(  2089 * _4mm_ARMATURES_GAIN )
        #define  _cal_default_rev_tank_threshold_current_ma_b3_si   current_ma_b3_si(  1488 * _4mm_ARMATURES_GAIN )
   #else
        #define  _cal_default_fwd_port_threshold_current_ma_b3_si   current_ma_b3_si( -2189 )
        #define  _cal_default_fwd_tank_threshold_current_ma_b3_si   current_ma_b3_si( -1624 )
        #define  _cal_default_rev_port_threshold_current_ma_b3_si   current_ma_b3_si(  2097 )
        #define  _cal_default_rev_tank_threshold_current_ma_b3_si   current_ma_b3_si(  1497 )
   #endif

   //old stuff
   //   #define  _cal_default_fwd_port_threshold_current_ma_b3_si   current_ma_b3_si( -2259 )
   //   #define  _cal_default_fwd_tank_threshold_current_ma_b3_si   current_ma_b3_si( -1534 )
   //   #define  _cal_default_rev_port_threshold_current_ma_b3_si   current_ma_b3_si(  2018 )
   //   #define  _cal_default_rev_tank_threshold_current_ma_b3_si   current_ma_b3_si(  1402 )

        // This value comes from the range of values experienced in the lab
        #define  _cal_default_threshold_delta_current_ma_b3_si      current_ma_b3_si( 353 ) // +/- X mA window to v

        // __state; 2nd parameter
        #define  _fnr_to_dcomd_INIT   0
        #define  _fnr_to_dcomd_NORM   1


    // ENUMERATIONS
        enum _state_estop_b0_uc_enum{ _state_estop_DEFAULT,
                                      _state_estop_INIT,
                                      _state_estop_DECEL,
                                      _state_estop_WAIT
                                    };

    // UNITS
```

*Fig. 9*

PROPULSION.C 23/02/2006 11:22:10

WR, T2, Propulsion Calibration Software

```
/****************
  MAPPING
****************/

  // REFERENCES:

  // INPUTS: DIGITAL - POSITIVE LOGIC...ON = NON-ZERO...OFF = 0.

  // INPUTS: ANALOG

  #define  _fnr_neutral_v_b11_si    ( (ee_fnr_sw_point_fwd_side_v_b11_ui + ee_fnr_sw_point_rev_side_v_b11_ui) / 2
  #define _propulsion_pwr_AtoD_raw              iomap_anin_12VD_power.raw
  #define _propulsion_pwr_AtoD_filtered         iomap_anin_12VD_power.filtered
  #define _propulsion_pwr_AtoD_state            iomap_anin_12VD_power.state
  #define _propulsion_pwr_swstate_raw           iomap_anin_swstate_12VD_power.raw
  #define _propulsion_pwr_swstate_debounced     (SWITCHES[6]._word.debounced & 0x0400)
  #define _propulsion_pwr_swstate_lh            iomap_anin_swstate_12VD_power.lh
  #define _propulsion_pwr_swstate_hl            iomap_anin_swstate_12VD_power.hl
  #define _fnr_neutral_switch_neutral           iomap_digin_swstate_S03_fnr_neutral.debounced            //Normal
  #define _propulsion_enabled                   propsafe_get_prop_enabled_logic_b_xp()    // 0 = disabled;  1 = e
  #define  _2SPD_switch_hi                      iomap_digin_swstate_S11_hi_gnd_speed.debounced     //1=switch in

  #define  _PROP_SHAFT_NEUT_CAL_STATE_INIT                          0
  #define  _PROP_SHAFT_NEUT_CAL_STATE_ENTRY                         1
  #define  _PROP_SHAFT_NEUT_CAL_STATE_ENTRY_TIME_LIMIT              2
  #define  _PROP_SHAFT_NEUT_CAL_STATE_ENTRY_WARNING_MSG             3
  #define  _PROP_SHAFT_NEUT_CAL_STATE_BEGIN_R_02                    4
  #define  _PROP_SHAFT_NEUT_CAL_STATE_BEGIN_R_23A                   5
  #define  _PROP_SHAFT_NEUT_CAL_STATE_BEGIN_R_23B                   6
  #define  _PROP_SHAFT_NEUT_CAL_STATE_CHECK                         7
  #define  _PROP_SHAFT_NEUT_CAL_STATE_PASSED                        8
  #define  _PROP_SHAFT_NEUT_CAL_STATE_FAILED                        9
  #define  _PROP_SHAFT_NEUT_CAL_STATE_EXIT                          10

  // OUTPUTS: DIGITAL - POSITIVE LOGIC...ON = NON-ZERO...OFF = 0.

  // OUTPUTS: PWM TYPE

/****************
  VARIABLES
****************/

  // GLOBAL SCOPE
     bit                  _propulsion_mfh_in_neutral_bt;
     signed int           EE_propulsion_valve_fwd_port_crack_ma_b3_si;     //jpeters2004Jun171702
     signed int           EE_propulsion_valve_fwd_tank_crack_ma_b3_si;    //jpeters2004Jun171702
     signed int           EE_propulsion_valve_rev_port_crack_ma_b3_si;    //jpeters2004Jun171702
     signed int           EE_propulsion_valve_rev_tank_crack_ma_b3_si;    //jpeters2004Jun171702
     unsigned char        state_external_b0_uc;
```

PROPULSION.C 23/02/2006 11:22:10

*Fig. 10*

WR, T2, Propulsion Calibration Software

```
// MODULE SCOPE
   static   bit            _fault_F404_set_flag_bt,
                           _fault_F409_03_set_flag_bt,
                           _fault_F410_07_set_flag_bt;
   static   signed int     _fnr_slope_pt1_v_b11_si;
   static   unsigned char  _neutral_pwr_off_flag_b0_uc;
   static   unsigned char  _valve_cal_state_b0_uc, _prev_valve_cal_state_b0_uc;
   signed   int            _valve_cal_current_ma_b3_si;
   static   unsigned char  _state_estop_b0_uc;
   static   unsigned char  _interactive_cal_proceed_flag_b0_uc;
   static   unsigned int   _timer01_ui, _timer02_ui;
   static   unsigned int   _prop_timer_ui;  //cfoster27aug2003 ret2N test
   static   unsigned char  _sensor_wiggle_state_b0_uc;
   static   signed int     _cyl_command, _disp_command_in_b12_si;
   static   unsigned char  _propulsion_ee_validation_status_b0_uc;

   static   struct   SFOX_FN  FN_fnr_v_b11_si_to_distance_d_b12_si[] =
   {
      { 0,  disp_in_b12_si(  2.000 ) },
      { 0,  disp_in_b12_si(  2.000 ) },
      { 0,  disp_in_b12_si(  0.400 ) },   //Slope transition point                  //(   410,  __disp   0.400
      { 0,  disp_in_b12_si(  0.000 ) },   //FNR neutral switch trip point, fwd side //(   515,  __disp   0.000
      { 0,  disp_in_b12_si(  0.000 ) },   //FNR neutral switch trip point, rev side //(   555,  __disp   0.000
      { 0,  disp_in_b12_si( -1.000 ) },
      { 0,  disp_in_b12_si( -1.000 ) }
   };

   static   const void*    _propulsion_valve_cal_error_msg;
   static   unsigned char  _shaft_neutral_cal_state_b0_uc;
   static   unsigned char  _prev_shaft_neutral_cal_state_b0_uc;
   static   bit            _ESTOP_started_by_park_brake_bt;

/****************
      FUNCTION PROTOTYPING - MODULE SCOPE
****************/

   static   signed int     _fnr_v_b11_si_to_distance_d_b12_si(signed int X);
   static   void           _propulsion_shaft_neutral_cal( void );
   static   void           put_ee_propulsion_valve_fwd_port_crack_ma_b3_ui( signed int ); //jpeters2004Jun2813
   static   void           put_ee_propulsion_valve_fwd_tank_crack_ma_b3_ui( signed int ); //jpeters2004Jun2813
   static   void           put_ee_propulsion_valve_rev_port_crack_ma_b3_ui( signed int ); //jpeters2004Jun2813
   static   void           put_ee_propulsion_valve_rev_tank_crack_ma_b3_ui( signed int ); //jpeters2004Jun2813

/*****************************************************************************/
void  propulsion( const unsigned int machine_mode_b0_ui )
{

   if( deluxe_model_b_xp )
```

*Fig. 11*

PROPULSION.C 23/02/2006 11:22:10

WR, T2, Propulsion Calibration Software

```
205     {
            switch( machine_mode_b0_ui )
            {
                case INIT_main_STATE_MACHINE:
                case CRITICAL_EE_VARS_OUT_OF_BOUNDS:
210             case WAKEUP_TEST_OUTPUTS:
                case WAKEUP_LIGHTS_ONLY:
                case NORMAL_ENGINE_OFF:
                case NORMAL_ENGINE_STARTING:
                case POWER_DOWN:
215             case  XCM_SETUP:
                      // do nothing
                break;

                case WAKEUP_APPLICATION_INIT:
220
                   propulsion_init();

                break;

225             case NORMAL_ENGINE_RUNNING:

                   if(   mfh_initialization_problem_b_xp()                  // FALSE == no problem was encountered
                      || steering_shaft_initialization_problem_b_xp()       // FALSE == no problem was encountered
                      || _propulsion_ee_validation_status_b0_uc             // 0x00 == no problem was encountered
230                )
                      propulsion_init();
                   else
                      propulsion_main();                                    // only run if no problem with both of them

235             break;

                case DIAG_N_SETUP_ENGINE_OFF:

                   _propulsion_shaft_neutral_cal();                         //prop shaft neutral cal access control and
240
                break;

                case CALIBRATION_ENGINE_STARTING:
                case CALIBRATION_ENGINE_RUNNING:
245
                   propulsion_valve_calibration();

                break;
            }
250     }
        else
        {
            switch( machine_mode_b0_ui )
            {
255             case DIAG_N_SETUP_ENGINE_OFF:
```

PROPULSION.C 23/02/2006 11:22:10

*Fig. 12*

WR, T2, Propulsion Calibration Software

```
                _propulsion_shaft_neutral_cal();                    //prop shaft neutral cal access control and
            break;
        }
    }
}

/*************************************************************************/
void propulsion_main(void)
{
#ifdef   engr_data_acq_prop_cal_crack_current      //mkc2005apr121420
CAN_test_data2[0].word = ee_propulsion_valve_fwd_port_crack_ma_b3_ui;
CAN_test_data2[1].word = ee_propulsion_valve_fwd_tank_crack_ma_b3_ui;
CAN_test_data2[2].word = ee_propulsion_valve_rev_port_crack_ma_b3_ui;
CAN_test_data2[3].word = ee_propulsion_valve_rev_tank_crack_ma_b3_ui;
#endif

    switch( _state_estop_b0_uc )
    {
        case _state_estop_DEFAULT:
            if(  mfh_R18_v_b11_ui_w_errors_returned() < 0xfb00 )          // if pot reading not out of range
                _disp_command_in_b12_si = ( _fnr_v_b11_si_to_distance_d_b12_si( mfh_R18_v_b11_ui_w_errors_returned()
        break;

        case _state_estop_INIT:
            _disp_command_in_b12_si = valid_steeringshaft_in_b12_si();     // ignore the mfh - commanded position no
            _state_estop_b0_uc = _state_estop_DECEL;

            if( !_ESTOP_started_by_park_brake_bt )                         // if not here because of park brake stat
                warning_add( _W049, _time2scans_b0 0 _sec_f );             //Propulsion fault warning

            if( _6_cylinder_b_xp )                                         // want to throttle back a 6 cyl machine
                throttle_set_to_low_idle();
        break;

        case _state_estop_DECEL:
            if( abs( _disp_command_in_b12_si ) < disp_in_b12_si( 0.010 ) )
            {
                _disp_command_in_b12_si = disp_in_b12_si( 0.000 );
                _state_estop_b0_uc = _state_estop_WAIT;
                break;
            }

            // make it a little more agressive - used to be 0.008
            if( _disp_command_in_b12_si > disp_in_b12_si( 0.000 ) )
                _disp_command_in_b12_si -= disp_in_b12_si( 0.009 );
            else if( _disp_command_in_b12_si < disp_in_b12_si( 0.000 ) )
                _disp_command_in_b12_si += disp_in_b12_si( 0.009 );
```

*Fig. 13*

PROPULSION.C 23/02/2006 11:22:10

WR, T2, Propulsion Calibration Software

```
            break;

            case _state_estop_WAIT:
310
               if( _ESTOP_started_by_park_brake_bt )                    // if here because of park brake state ma
               {
                  if(   !propsafe_get_prop_enabled_logic_b_xp()         //    wait for no prop power FALSE = disa
                     && mfh_is_back_to_neutral_status_xp()              //AND the mfh back to neutral
315               }
                  {
                     _ESTOP_started_by_park_brake_bt = FALSE;
                     _state_estop_b0_uc = _state_estop_DEFAULT;
                  }
320            }
               else
                  _disp_command_in_b12_si = disp_in_b12_si( 0.000 );

            break;
325
            default:
            break;
         );

330      if(   _propulsion_pwr_AtoD_filtered < _SYSTEM_5_VOLT_THRESHOLD   //    if no +12VD propulsion power
            || !_propulsion_enabled                                       // OR if propulsion disabled
            || park_brake_status_on_bt_xp                                 // OR if park brake on
         )
         {
335         DispPID_init();
            DispPID_main(0);
            propulsion_Icntrl_init();
            propulsion_Icntrl_setpt( 0 );                                 //TBDrps2005jan170744 Fairly confident th

340         return;
         }
         else
            propulsion_Icntrl_setpt( DispPID_main( _disp_command_in_b12_si ));   //rstross2003Jan130455

345 }


      /*****************************************************************/
      void  propulsion_ee_validation( void )
350   {
      /*
         Need to store these as unsigned ints (with offset) and then after they are recalled
         the user module will remove the offset and use it as a signed int.  If there is a problem with any of these 4
         registers we want to change the out-of-bounds register to 0xfe00 and have this function return a value other t
355      Then the main state machine should hang up in the CRITICAL_EE_VARS_OUT_OF_BOUNDS state which will force a reca
         strategy.
```

PROPULSION.C 23/02/2006 11:22:10

*Fig. 14*

WR, T2, Propulsion Calibration Software

```
        This function is called from [EE_vars.c].EE_critical_vars_validation() which is called from [main.c].main().
        is not used as of 2004dec151020.  The return value of calculated in [EE_vars.c].EE_critical_vars_validation()
        [EE_vars.c].int* ee_get_status_pi( void ).
    */

        if( economy_model_b_xp )
           return;

        EE_propulsion_valve_fwd_port_crack_ma_b3_si =
        EE_propulsion_valve_fwd_tank_crack_ma_b3_si =
        EE_propulsion_valve_rev_port_crack_ma_b3_si =
        EE_propulsion_valve_rev_tank_crack_ma_b3_si = 0x0000;                    // first reset all to zero

        _propulsion_ee_validation_status_b0_uc = 0;                              // means we're OK - good to go

        if( ee_propulsion_valve_fwd_port_crack_ma_b3_ui > 0xfaff )               // if there's already an error
        {
           _propulsion_ee_validation_status_b0_uc |= ee_PROPULSION_VALVE_FWD_PORT_CRACK_FAULT_MASK;
           fault_log_add_fault( _F424_13 );                                      // add fault
        }

        if( ee_propulsion_valve_fwd_tank_crack_ma_b3_ui > 0xfaff )               // if there's already an error
        {
           _propulsion_ee_validation_status_b0_uc |= ee_PROPULSION_VALVE_FWD_TANK_CRACK_FAULT_MASK;
           fault_log_add_fault( _F425_13 );                                      // add fault
        }

        if( ee_propulsion_valve_rev_port_crack_ma_b3_ui > 0xfaff )               // if there's already an error
        {
           _propulsion_ee_validation_status_b0_uc |= ee_PROPULSION_VALVE_REV_PORT_CRACK_FAULT_MASK;
           fault_log_add_fault( _F426_13 );                                      // add fault
        }

        if( ee_propulsion_valve_rev_tank_crack_ma_b3_ui > 0xfaff )               // if there's already an error
        {
           _propulsion_ee_validation_status_b0_uc |= ee_PROPULSION_VALVE_REV_TANK_CRACK_FAULT_MASK;
           fault_log_add_fault( _F427_13 );                                      // add fault
        }
    }


    /*****************************************************************/
    unsigned char  propulsion_ee_validation_status_b0_uc( void )
    {
        return( _propulsion_ee_validation_status_b0_uc );                        // if this is not zero there
    }

    /*******************************************************************/
    void propulsion_init(void)
    {
```

PROPULSION.C 23/02/2006 11:22:10

*Fig. 15*

WR, T2, Propulsion Calibration Software

```
410     if( _propulsion_ee_validation_status_b0_uc )                                  // if any one of them is out of
        {

    // TBDBOB - there may be something that you need to do here

415        return;                                                                    // don't bother with anything el
        }
        else
        {
           //Convert unsigned int ee variables to signed integers for program use.
420        //Currents are stored as BIN3 with a 4Amp (4000 ma) offset
           EE_propulsion_valve_fwd_port_crack_ma_b3_si = (signed int)( ee_propulsion_valve_fwd_port_crack_ma_b3_ui - (
           EE_propulsion_valve_fwd_tank_crack_ma_b3_si = (signed int)( ee_propulsion_valve_fwd_tank_crack_ma_b3_ui - (
           EE_propulsion_valve_rev_port_crack_ma_b3_si = (signed int)( ee_propulsion_valve_rev_port_crack_ma_b3_ui - (
           EE_propulsion_valve_rev_tank_crack_ma_b3_si = (signed int)( ee_propulsion_valve_rev_tank_crack_ma_b3_ui - (
425
           // EE testing and validation tests the setpoints

           if(   EE_propulsion_valve_fwd_port_crack_ma_b3_si < _cal_default_fwd_port_threshold_current_ma_b3_si - _cal
              || EE_propulsion_valve_fwd_port_crack_ma_b3_si > _cal_default_fwd_port_threshold_current_ma_b3_si + _cal
430        {
              _propulsion_ee_validation_status_b0_uc |= EE_PROPULSION_VALVE_FWD_TANK_CRACK_FAULT_MASK;
              fault_log_add_fault( _F424_13 );                                        // add fault
              //Warning will be displayed when propulsion_main is called Operator should be alerted to run valve calib
              ee_propulsion_valve_fwd_port_crack_ma_b3_ui = 0xfc00;                   // error
435        }

           if(   EE_propulsion_valve_fwd_tank_crack_ma_b3_si < _cal_default_fwd_tank_threshold_current_ma_b3_si - _cal
              || EE_propulsion_valve_fwd_tank_crack_ma_b3_si > _cal_default_fwd_tank_threshold_current_ma_b3_si + _cal
           {
440           _propulsion_ee_validation_status_b0_uc |= EE_PROPULSION_VALVE_FWD_PORT_CRACK_FAULT_MASK;
              fault_log_add_fault( _F425_13 );                                        // add fault
              //Warning will be displayed when propulsion_main is called Operator should be alerted to run valve calib
              ee_propulsion_valve_fwd_tank_crack_ma_b3_ui = 0xfc00;                   // error
           }
445
           if(   EE_propulsion_valve_rev_port_crack_ma_b3_si > _cal_default_rev_port_threshold_current_ma_b3_si + _cal
              || EE_propulsion_valve_rev_port_crack_ma_b3_si < _cal_default_rev_port_threshold_current_ma_b3_si - _cal
           {
              _propulsion_ee_validation_status_b0_uc |= EE_PROPULSION_VALVE_REV_TANK_CRACK_FAULT_MASK;
450           fault_log_add_fault( _F426_13 );                                        // add fault
              //Warning will be displayed when propulsion_main is called Operator should be alerted to run valve calib
              ee_propulsion_valve_rev_port_crack_ma_b3_ui = 0xfc00;                   // error
           }

455        if(   EE_propulsion_valve_rev_tank_crack_ma_b3_si > _cal_default_rev_tank_threshold_current_ma_b3_si + _cal
              || EE_propulsion_valve_rev_tank_crack_ma_b3_si < _cal_default_rev_tank_threshold_current_ma_b3_si - _cal
           {
              _propulsion_ee_validation_status_b0_uc |= EE_PROPULSION_VALVE_REV_PORT_CRACK_FAULT_MASK;
              fault_log_add_fault( _F427_13 );                                        // add fault
```

PROPULSION.C 23/02/2006 11:22:10

*Fig. 16*

WR, T2, Propulsion Calibration Software

```
460          //Warning will be displayed when propulsion_main is called Operator should be alerted to run valve calib
             ee_propulsion_valve_rev_tank_crack_ma_b3_ui = 0xfc00;                    // error
          }
       }

465
       DispPID_init();

       propulsion_Icntrl_init();

470    _state_estop_b0_uc = _state_estop_DEFAULT;
       _prop_timer_ui = _timer01_ui=_timer02_ui=0;
       _cyl_command=0;
       _valve_cal_state_b0_uc = 0;
       _ESTOP_started_by_park_brake_bt = FALSE;
475
       _fault_F409_03_set_flag_bt = _fault_F410_07_set_flag_bt = 0;

       _fnr_slope_pt1_v_b11_si = ( ( (ee_fnr_full_fwd_v_b11_ui) + (2 * (ee_mfh_fwd_swpoint_going_out_v_b11_ui) ) )/3

480    FN_fnr_v_b11_si_to_distance_d_b12_si[0].x =  0x8000;
       FN_fnr_v_b11_si_to_distance_d_b12_si[1].x =  ee_fnr_full_fwd_v_b11_ui;
       FN_fnr_v_b11_si_to_distance_d_b12_si[2].x =  _fnr_slope_pt1_v_b11_si;
       FN_fnr_v_b11_si_to_distance_d_b12_si[3].x =  ee_mfh_fwd_swpoint_going_out_v_b11_ui;
       FN_fnr_v_b11_si_to_distance_d_b12_si[4].x =  ee_mfh_rev_swpoint_going_out_v_b11_ui;
485    FN_fnr_v_b11_si_to_distance_d_b12_si[5].x =  ee_fnr_full_rev_v_b11_ui;
       FN_fnr_v_b11_si_to_distance_d_b12_si[6].x =  0x7fff;

       _sensor_wiggle_state_b0_uc = 0;

490 }


    /*************************************************************************/
    static   void put_ee_propulsion_valve_fwd_port_crack_ma_b3_ui( signed int __X )
495 {
       EE_propulsion_valve_fwd_port_crack_ma_b3_si = __X;
       ee_propulsion_valve_fwd_port_crack_ma_b3_ui = (unsigned int)( __X + ( 4000 * BIN3 ) );
    }

500
    /*************************************************************************/
    static   void put_ee_propulsion_valve_fwd_tank_crack_ma_b3_ui( signed int __X )
    {
       EE_propulsion_valve_fwd_tank_crack_ma_b3_si = __X;
505    ee_propulsion_valve_fwd_tank_crack_ma_b3_ui = (unsigned int)( __X + ( 4000 * BIN3 ) );
    }


    /*************************************************************************/
510 static   void put_ee_propulsion_valve_rev_port_crack_ma_b3_ui( signed int __X )
```

PROPULSION.C 23/02/2006 11:22:10

*Fig. 17*

WR, T2, Propulsion Calibration Software

```
    {
       EE_propulsion_valve_rev_port_crack_ma_b3_si = __X;
       ee_propulsion_valve_rev_port_crack_ma_b3_ui = (unsigned int)( __X + ( 4000 * BIN3 ) );
    }

    /*************************************************************************/
    static   void put_ee_propulsion_valve_rev_tank_crack_ma_b3_ui( signed int __X )
    {
       EE_propulsion_valve_rev_tank_crack_ma_b3_si = __X;
       ee_propulsion_valve_rev_tank_crack_ma_b3_ui = (unsigned int)( __X + ( 4000 * BIN3 ) );
    }


    /*************************************************************************/
    void load_propulsion_defaults( void )
    {

       put_ee_propulsion_valve_fwd_port_crack_ma_b3_ui( _cal_default_fwd_port_threshold_current_ma_b3_si );  // -2259
       put_ee_propulsion_valve_fwd_tank_crack_ma_b3_ui( _cal_default_fwd_tank_threshold_current_ma_b3_si );  // -1534
       put_ee_propulsion_valve_rev_port_crack_ma_b3_ui( _cal_default_rev_port_threshold_current_ma_b3_si );  //  2018
       put_ee_propulsion_valve_rev_tank_crack_ma_b3_ui( _cal_default_rev_tank_threshold_current_ma_b3_si );  //  1402

       load_steering_shaft_defaults();     // 6 steering shaft calibration ee values
       load_mfh_calpoint_defaults();       // 6 mfh calibration ee values

    }


    /*************************************************************************/
    void propulsion_ESTOP_state_machine_start( void )
    {
    /*
    Reveiwed...rps2004dec160725
    Used in propulsion.c only as of rps2004dec160754
    */
       _state_estop_b0_uc = _state_estop_INIT;
    }

    /*************************************************************************/
    void propulsion_ESTOP_state_machine_started_by_park_brake( void )
    {
       _ESTOP_started_by_park_brake_bt = TRUE;
       _state_estop_b0_uc = _state_estop_INIT;
    }


    /*****************************************************************************/
    signed int _fnr_v_b11_si_to_distance_d_b12_si(signed int X)
    {
```

PROPULSION.C 23/02/2006 11:22:10

*Fig. 18*

WR, T2, Propulsion Calibration Software

```
        /*
        DESCRIPTION:   FNR Volts to inch Displacement Command

                       X: Volts BIN12 signed int
                       Y: Drive Cylinder Displacement Command inches BIN12 signed int

        */
    /*
        static struct SFOX_FN FN[] =
        {
        { 0x8000                          , _disp  2.000    _in_b12_si },
        { EE_fnr_full_fwd_v_b11_si        , _disp  2.000    _in_b12_si },
        { _fnr_slope_pt1_v_b11_si         , _disp  0.400    _in_b12_si }, //Slope transition point
        { EE_fnr_sw_point_fwd_side_v_b11_si , _disp  0.000    _in_b12_si }, //FNR neutral switch trip point, fwd side
        { EE_fnr_sw_point_rev_side_v_b11_si , _disp  0.000    _in_b12_si }, //FNR neutral switch trip point, rev side
        { EE_fnr_full_rev_v_b11_si        , _disp -1.000    _in_b12_si },
        { 0x7fff                          , _disp -1.000    _in_b12_si }
        };
            SRFOXW_INLINE;
    */

    return( SRFOXW( FN_fnr_v_b11_si_to_distance_d_b12_si, X) );  //jpeters2003Aug121310 See FN1...FNx above.  Table i
    }

    /*****************************************************************************/
    signed int R18_v_b11_ui_w_errors_si_to_distance_d_b12_si_test( void )
    {
        // Get FNR handle disp command
        return( _fnr_v_b11_si_to_distance_d_b12_si( mfh_R18_v_b11_ui_w_errors_returned() ) );
    }


/*****************************************************************************/
    void propulsion_valve_calibration(void)
    {
    /*
        WHEELS MUST BE LOCKED OUT BEFORE RUNNING THIS FUCTION!!!
*/

            static unsigned char __update_display_flag_b0_uc;
            static const void*   _propulsion_valve_cal_msg;
            static unsigned int __timer01;
            static unsigned char __count;
            static signed int    __i_inc_ma_b3_si;
            static signed int    _valve_cal_start_current_ma_b3_si;
            static signed int    _valve_cal_tmp_current_ma_b3_si;
            enum __state_offset
            {
                __state_offset_b0_ui_0,
                __state_offset_b0_ui_1,
```

Fig. 19

WR, T2, Propulsion Calibration Software

```
            __state_offset_b0_ui_2,
            __state_offset_b0_ui_3,
            __state_offset_b0_ui_4
        };

        static unsigned int  __state_offset_b0_ui;
        static signed int    __valve_position_1_b0_si;
        static signed int    __valve_position_2_b0_si;
        static signed int    __valve_position_sum_b0_si;
        static unsigned char __movement_count_b0_uc;
        static unsigned char __iteration_count_b0_uc;
        static unsigned int __entry_timer;

        #define     _num_threshold_counts                    3 // Need at least this many samples beyond thresh

        #define     _VALVE_CAL_STATE_INIT                    0
        #define     _VALVE_CAL_STATE_ENTRY                   1
        #define     _VALVE_CAL_STATE_ENTRY_TIME_LIMIT        2
        #define     _VALVE_CAL_STATE_ENTRY_WARNING_MSG       3
        #define     _VALVE_CAL_STATE_BEGIN                   4
        #define     _VALVE_CAL_STATE_START_ENGINE            5
        #define     _VALVE_CAL_STATE_WAIT_FOR_ENG_RUNNING    6
        #define     _VALVE_CAL_STATE_CHECK_FOR_LOW_IDLE      7
        #define     _VALVE_CAL_STATE_WAIT_FOR_LOW_IDLE       8
        #define     _VALVE_CAL_STATE_WARNING                 9
        #define     _VALVE_CAL_STATE_CYL_FWD_PORT_INIT       10
        #define     _VALVE_CAL_STATE_CYL_FWD_PORT_SNAPSHOT   11
        #define     _VALVE_CAL_STATE_TEST_FOR_FWD_PORT       12
        #define     _VALVE_CAL_STATE_GOTO_FULL_FWD           13
        #define     _VALVE_CAL_STATE_CYL_FWD_TANK_INIT       14
        #define     _VALVE_CAL_STATE_CYL_FWD_TANK_SNAPSHOT   15
        #define     _VALVE_CAL_STATE_TEST_FOR_FWD_TANK       16
        #define     _VALVE_CAL_STATE_FWD_GOTO_NEUTRAL        17
        #define     _VALVE_CAL_STATE_CYL_REV_PORT_INIT       18
        #define     _VALVE_CAL_STATE_CYL_REV_PORT_SNAPSHOT   19
        #define     _VALVE_CAL_STATE_TEST_FOR_REV_PORT       20
        #define     _VALVE_CAL_STATE_GOTO_FULL_REV           21
        #define     _VALVE_CAL_STATE_CYL_REV_TANK_INIT       22
        #define     _VALVE_CAL_STATE_CYL_REV_TANK_SNAPSHOT   23
        #define     _VALVE_CAL_STATE_TEST_FOR_REV_TANK       24
        #define     _VALVE_CAL_STATE_REV_GOTO_NEUTRAL        25
        #define     _VALVE_CAL_STATE_PASSED                  26
        #define     _VALVE_CAL_STATE_FAILED                  27
        #define     _VALVE_CAL_STATE_FAILURE_MESSAGE         28
        #define     _VALVE_CAL_STATE_CHECK_CONFIG            29
        #define     _VALVE_CAL_STATE_EXIT                    30
        #define     _VALVE_CAL_STATE_BEGIN_01                31
        #define     _VALVE_CAL_STATE_BEGIN_02                32
        #define     _VALVE_CAL_STATE_BEGIN_03                33
        #define     _valve_cal_state_FWD_04                  34
        #define     _valve_cal_state_FWD_05                  35
```

PROPULSION.C 23/02/2006 11:22:10

*Fig. 20*

WR, T2, Propulsion Calibration Software

```
#define     _valve_cal_state_FWD_06                    36
#define     _valve_cal_state_FWD_07                    37
#define     _valve_cal_state_FWD_08                    38
#define     _valve_cal_state_GET_R23_REVERSE           39
#define     _valve_cal_state_GET_R23_FORWARD           40
#define     _valve_cal_state_SET_NEUT_CAL_MSG          41

state_external_b0_uc =  (unsigned char)(_valve_cal_state_b0_uc + 10*__state_offset_b0_ui);                    //

if( _valve_cal_state_b0_uc > _VALVE_CAL_STATE_ENTRY_WARNING_MSG )                          // we need the
   external_park_brake_release();

switch( _valve_cal_state_b0_uc )
{
   case  _VALVE_CAL_STATE_INIT:
      _valve_cal_current_ma_b3_si = 0;                                                                         //
      __timer01 = __count = 0;                                                                                 //
   return;

   case  _VALVE_CAL_STATE_ENTRY:

      _propulsion_valve_cal_msg = _read_service_manual_menu;              //display "Read Service Manual" mes
      __entry_timer = 0;
      _valve_cal_state_b0_uc = _VALVE_CAL_STATE_ENTRY_TIME_LIMIT;

   break;

   case  _VALVE_CAL_STATE_ENTRY_TIME_LIMIT:

      if( ++__entry_timer >= _time_b0_ui2scans_sec_f( 3.0 ) )             //3 second maximum time allowed
      {
         _propulsion_valve_cal_error_msg = _cal_failed_menu;
         _valve_cal_state_b0_uc = _VALVE_CAL_STATE_FAILED;
      }

      if( rt_trim_incr_lh )                                               //right trim increase switch presse
      {
         __entry_timer = 0;                                               //reset entry timer
         Alarm_RapidMod_5sec();                                           //give a 5 secs with rapid modulati
         _valve_cal_state_b0_uc = _VALVE_CAL_STATE_ENTRY_WARNING_MSG;     //go to next state
      }

   break;

   case  _VALVE_CAL_STATE_ENTRY_WARNING_MSG:

      _propulsion_valve_cal_msg = _valve_cal_entry_warning_msg_menu;      //display entry warning message

   break;
```

PROPULSION.C 23/02/2006 11:22:10

*Fig. 21*

WR, T2, Propulsion Calibration Software

```
715        case  _VALVE_CAL_STATE_BEGIN:

              propsafe_propcal_begin();

              ee_steering_shaft_primary_neutral_v_b11_ui =
720           ee_steering_shaft_primary_extended_v_b11_ui =
              ee_steering_shaft_primary_retracted_v_b11_ui =
              ee_steering_shaft_secondary_neutral_v_b11_ui =
              ee_steering_shaft_secondary_extended_v_b11_ui =
              ee_steering_shaft_secondary_retracted_v_b11_ui = 0xfc00;          // you've committed... must do a va
725
              _valve_cal_current_ma_b3_si = 0;                                  //Initialize valv
              _propulsion_valve_cal_msg = _valve_cal_init_warning_menu;         /*
                                                                                   Display a mess
                                                                                   wheels out bef
730                                                                                choose exit to
                                                                                */
              if( _interactive_cal_proceed_flag_b0_uc )                         //Check menu syst
              {
                 _propulsion_valve_cal_msg = _cal_start_eng_menu;               //Que Display...s
735              _valve_cal_state_b0_uc = _VALVE_CAL_STATE_START_ENGINE;        //Que next state
              }
              if( economy_model_b_xp )                                          //If Standard mac
                 _valve_cal_state_b0_uc = _VALVE_CAL_STATE_CHECK_CONFIG;
           break;
740
           case _VALVE_CAL_STATE_START_ENGINE:
              neustart_set_hubs_are_locked_out_bt();
              menu_change_focus( _cal_start_eng_menu, _type_menu_e );       //Prompt operator to
              _valve_cal_state_b0_uc = _VALVE_CAL_STATE_WAIT_FOR_ENG_RUNNING;  //Que next state
745        break;

           case _VALVE_CAL_STATE_WAIT_FOR_ENG_RUNNING:
              neustart_set_hubs_are_locked_out_bt();
              if( engine_running_b_xp )                                         //Check if engine
750              _valve_cal_state_b0_uc = _VALVE_CAL_STATE_CHECK_FOR_LOW_IDLE;  //Que next state
           break;

           case _VALVE_CAL_STATE_CHECK_FOR_LOW_IDLE:
              if( engine_low_idle_b_xp )                                        //Check for low i
755              _valve_cal_state_b0_uc = _VALVE_CAL_STATE_WARNING;             //Que next state
              else
              {
                 _propulsion_valve_cal_msg = _decrease_engine_speed_to_low_idle_menu;  //Que Display...d
                 _valve_cal_state_b0_uc = _VALVE_CAL_STATE_WAIT_FOR_LOW_IDLE;   //Que next state
760           }
           break;

           case _VALVE_CAL_STATE_WAIT_FOR_LOW_IDLE:
              if( engine_low_idle_b_xp )                                        //Check for low i
765              _valve_cal_state_b0_uc = _VALVE_CAL_STATE_WARNING;             //Que next state
```

PROPULSION.C 23/02/2006 11:22:10

*Fig. 22*

WR, T2, Propulsion Calibration Software

```
            break;

            case  _VALVE_CAL_STATE_WARNING:
               _propulsion_valve_cal_msg = _valve_cal_start_warning_menu;                    //Que Display...o

               if( park_brake_status_off_bt_xp && mfh_is_out_of_neutral_status_xp() )        // check for brak
                  _valve_cal_state_b0_uc = _VALVE_CAL_STATE_CYL_FWD_PORT_INIT;               //Que next state

            break;

     /*
     << STROKE CYLINDER BACK AND FORTH 3 TIMES >>

     energize L-15 (reverse solenoid) for 2 seconds
        current displayed is 2800 (2.80 amps)
        cylinder should fully retract
        R23A voltage on display should be approx 1.47v
        R23B voltage (not displayed) should be approx 3.58v

     energize L-14 (forward solenoid) for 3 seconds
        current displayed is -2800 (2.80 amps)
        cylinder should fully extend
        R23A voltage on display should be approx 4.08v
        R23B voltage (not displayed) should be approx 1.02v

     energize L-15 (reverse solenoid) for 2 seconds
        current displayed is 2800 (2.80 amps)
        cylinder should fully retract
        R23A voltage on display should be approx 1.47v
        R23B voltage (not displayed) should be approx 3.58v

     energize L-14 (forward solenoid) for 3 seconds
        current displayed is -2800 (2.80 amps)
        cylinder should fully extend
        R23A voltage on display should be approx 4.08v
        R23B voltage (not displayed) should be approx 1.02v

     energize L-15 (reverse solenoid) for 2 seconds
        current displayed is 2800 (2.80 amps)
        cylinder should fully retract
        R23A voltage on display should be approx 1.47v
        R23B voltage (not displayed) should be approx 3.58v

     energize L-14 (forward solenoid) for 3 seconds
        current displayed is -2800 (2.80 amps)
        cylinder should fully extend
        R23A voltage on display should be approx 4.08v
        R23B voltage (not displayed) should be approx 1.02v
     */

            case  _VALVE_CAL_STATE_CYL_FWD_PORT_INIT:
```

PROPULSION.C 23/02/2006 11:22:10

*Fig. 23*

WR; T2, Propulsion Calibration Software

```
            _propulsion_valve_cal_msg = _valve_cal_running_menu;                    //Que Display...o
            _valve_cal_current_ma_b3_si = current_ma_b3_si( 2800 );                 //Stroke prop cyl
            if( ++__timer01 == _time_b0_ui2scans_sec_f( 2.00 ) )                    //Delay n seconds
            {
               __timer01 = 0;                                                       //Reset local tem
               _valve_cal_state_b0_uc = _VALVE_CAL_STATE_BEGIN_01;                  //Que next state
            }
         break;

         case  _VALVE_CAL_STATE_BEGIN_01:
            _valve_cal_current_ma_b3_si = current_ma_b3_si( -2800 );                //Stroke prop cyl
            if( ++__timer01 == _time_b0_ui2scans_sec_f( 3.00 ) )                    //Delay n seconds
            {
               if( ++__count == 4 )                                                 //If n cycles com
               {
                  __timer01=0;                                                      //Reset local tem
                  _valve_cal_state_b0_uc = _valve_cal_state_GET_R23_REVERSE;        //Que next state
               }
               else
               {
                  __timer01 = 0;                                                    //Reset local tem
                  _valve_cal_state_b0_uc = _VALVE_CAL_STATE_CYL_FWD_PORT_INIT;      //Que next state
               }
            }
         break;


/*
   << FULLY RETRACT CYLINDER AND TEST CYLINDER POTENTIOMETER VOLTAGE >>

   energize L-15 (reverse solenoid) for 4 seconds
      current displayed is 2800 (2.80 amps)
      R23A fully retracted nominal voltage is 1.469, limits are 1.051 to 1.887
      R23B fully retracted nominal voltage is 3.578, limits are 3.018 to 4.138
      test retracted calibration values against expected limits
      exit and declare failure if beyond limits - continue if OK
   */

         case _valve_cal_state_GET_R23_REVERSE:
            _valve_cal_current_ma_b3_si = current_ma_b3_si( 2800 );                 //Stroke prop cyl
            if( ++__timer01 == _time_b0_ui2scans_sec_f( 4.00 ) )                    //Delay n seconds
            {
               //Set Cylinder Pot retracted calibration value
               ee_steering_shaft_primary_retracted_v_b11_ui = R23A_AtoD_b0_ui_to_v_b11_ui();
               ee_steering_shaft_secondary_retracted_v_b11_ui = R23B_AtoD_b0_ui_to_v_b11_ui();

               //Call function to perform a check of steering shaft calibration values
               steering_shaft_retracted_ee_validation();

               if(   steering_shaft_ee_validation_status_b0_uc_returned()
```

PROPULSION.C 23/02/2006 11:22:10

*Fig. 24*

WR, T2, Propulsion Calibration Software

```
                    & ( EE_PRIMARY_RETRACTED_FAULT_MASK | EE_SECONDARY_RETRACTED_FAULT_MASK )
                 }
                 {
                    _propulsion_valve_cal_error_msg = _cal_ee_error_menu;
                    _valve_cal_state_b0_uc = _VALVE_CAL_STATE_FAILED;
                 }
                 else
                 {
                    __timer01 = 0;                                                          //Res
                    _valve_cal_state_b0_uc = _valve_cal_state_GET_R23_FORWARD;              //Que
                 }
              }
           break;

     /*
     << FULLY EXTEND CYLINDER AND TEST CYLINDER POTENTIOMETER VOLTAGE >>
     energize L-14 (forward solenoid) for 4 seconds
        current displayed is -2800 (2.80 amps)
        R23A fully extended nominal voltage is 4.085, limits are 3.535 to 4.635
        R23B fully extended nominal voltage is 1.018, limits are 0.616 to 1.420
        test extended calibration values against expected limits
        exit and declare failure if beyond limits - continue if OK
     */

           case _valve_cal_state_GET_R23_FORWARD:
              _valve_cal_current_ma_b3_si = current_ma_b3_si( -2800 );
              if( ++__timer01 == _time_b0_ui2scans_sec_f( 4.00 ) )                          //
              {
                 //Set Cylinder Pot extended calibration value
                 ee_steering_shaft_primary_extended_v_b11_ui = R23A_AtoD_b0_ui_to_v_b11_ui();
                 ee_steering_shaft_secondary_extended_v_b11_ui = R23B_AtoD_b0_ui_to_v_b11_ui();

                 steering_shaft_extended_ee_validation();          //Call function to perform a check of steering

                 if(   steering_shaft_ee_validation_status_b0_uc_returned()
                    & ( EE_PRIMARY_EXTENDED_FAULT_MASK | EE_SECONDARY_EXTENDED_FAULT_MASK )
                 }
                 {
                    _propulsion_valve_cal_error_msg = _cal_ee_error_menu;
                    _valve_cal_state_b0_uc = _VALVE_CAL_STATE_FAILED;
                 }
                 else
                 {
                    __timer01=0;                                                            //
                    __state_offset_b0_ui = __state_offset_b0_ui_0;                          //
                    __i_inc_ma_b3_si = 0;                                                   //
                    _valve_cal_state_b0_uc = _valve_cal_state_FWD_04;                       //
                 }
              }
```

PROPULSION.C 23/02/2006 11:22:10

*Fig. 25*

WR, T2, Propulsion Calibration Software

```
920        break;

     /*
       R23A prop_cyl neutral nominal is 2.394, limits are 1.900 to 2.888
       R23B prop_cyl neutral nominal is 2.530, limits are 2.025 to 3.035
925
     _cal_default_fwd_port          -2189
     _cal_default_fwd_tank          -1624
     _cal_default_rev_port           2097
     _cal_default_rev_tank           1497
930
     _cal_default_threshold_delta     353
     */

           case _valve_cal_state_FWD_04:
935        /*
           Description:  This state is responsible for...
           */

              if( abs(__i_inc_ma_b3_si /= 2) < current_ma_b3_si( 5.00 )   )                                    //
940           {
                 __valve_position_2_b0_si = 0;                                                                  //
                 switch( __state_offset_b0_ui )
                 {
                    case __state_offset_b0_ui_0:
945                    __movement_count_b0_uc = __iteration_count_b0_uc = 0;                                    //
                       _valve_cal_current_ma_b3_si = _valve_cal_start_current_ma_b3_si = current_ma_b3_si( 0 );  //
                       _valve_cal_tmp_current_ma_b3_si = _cal_default_fwd_port_threshold_current_ma_b3_si;       //
                       __i_inc_ma_b3_si = -_cal_default_threshold_delta_current_ma_b3_si;                       //
                       _valve_cal_state_b0_uc = _valve_cal_state_FWD_05;                                        //
950                 break;
                    case __state_offset_b0_ui_1:
                       if(__movement_count_b0_uc == __iteration_count_b0_uc )                                   //
                       {
                          fault_log_add_fault( _F424_04 );                                                      //
955                       ee_propulsion_valve_fwd_port_crack_ma_b3_ui = 0xfb00;                                 //
                          _propulsion_valve_cal_error_msg = _valve_cal_fwdport_menu;                            //
                          _valve_cal_state_b0_uc = _VALVE_CAL_STATE_FAILED;                                     //
                          break;
                       }
960                    if( __movement_count_b0_uc == 0 )                                                        //
                       {
                          fault_log_add_fault( _F424_03 );                                                      //
                          ee_propulsion_valve_fwd_port_crack_ma_b3_ui = 0xfe00;                                 //
                          _propulsion_valve_cal_error_msg = _valve_cal_fwdport_menu;                            //
965                       _valve_cal_state_b0_uc = _VALVE_CAL_STATE_FAILED;                                     //
                          break;
                       }
                       put_ee_propulsion_valve_fwd_port_crack_ma_b3_ui ( _valve_cal_current_ma_b3_si );         //
                       __movement_count_b0_uc = __iteration_count_b0_uc = 0;                                    //
```

PROPULSION.C 23/02/2006 11:22:10

*Fig. 26*

WR, T2, Propulsion Calibration Software

```
970                 _valve_cal_current_ma_b3_si = _valve_cal_start_current_ma_b3_si = current_ma_b3_si( -2800 ); //
                    _valve_cal_tmp_current_ma_b3_si = _cal_default_fwd_tank_threshold_current_ma_b3_si;          //
                    __i_inc_ma_b3_si = _cal_default_threshold_delta_current_ma_b3_si;                            //
                    _valve_cal_state_b0_uc = _valve_cal_state_FWD_05;                                            //
                 break;
975              case __state_offset_b0_ui_2:
                    if(__movement_count_b0_uc == __iteration_count_b0_uc )                                       //
                    {
                       fault_log_add_fault( _F425_04 );                                                          //
                       ee_propulsion_valve_fwd_tank_crack_ma_b3_ui = 0xfb00;                                     //
980                    _propulsion_valve_cal_error_msg = _valve_cal_fwdtank_menu;                                //
                       _valve_cal_state_b0_uc = _VALVE_CAL_STATE_FAILED;                                         //
                       break;
                    }
                    if( __movement_count_b0_uc == 0 )                                                            //
985                 {
                       fault_log_add_fault( _F425_03 );                                                          //
                       ee_propulsion_valve_fwd_tank_crack_ma_b3_ui = 0xfe00;                                     //
                       _propulsion_valve_cal_error_msg = _valve_cal_fwdtank_menu;                                //
                       _valve_cal_state_b0_uc = _VALVE_CAL_STATE_FAILED;                                         //
990                    break;
                    }
                    put_ee_propulsion_valve_fwd_tank_crack_ma_b3_ui ( _valve_cal_current_ma_b3_si );             //
                    __movement_count_b0_uc = __iteration_count_b0_uc = 0;                                        //
                    _valve_cal_current_ma_b3_si = _valve_cal_start_current_ma_b3_si = current_ma_b3_si( 0 );     //
995                 _valve_cal_tmp_current_ma_b3_si = _cal_default_rev_port_threshold_current_ma_b3_si;          //
                    __i_inc_ma_b3_si = _cal_default_threshold_delta_current_ma_b3_si;                            //
                    _valve_cal_state_b0_uc = _valve_cal_state_FWD_05;                                            //
                 break;
                 case __state_offset_b0_ui_3:
1000                if(__movement_count_b0_uc == __iteration_count_b0_uc )                                       //
                    {
                       fault_log_add_fault( _F426_04 );                                                          //
                       ee_propulsion_valve_rev_port_crack_ma_b3_ui = 0xfb00;                                     //
                       _propulsion_valve_cal_error_msg = _valve_cal_revport_menu;                                //
1005                   _valve_cal_state_b0_uc = _VALVE_CAL_STATE_FAILED;                                         //
                       break;
                    }
                    if( __movement_count_b0_uc == 0 )                                                            //
                    {
1010                   fault_log_add_fault( _F426_03 );                                                          //
                       ee_propulsion_valve_rev_port_crack_ma_b3_ui = 0xfe00;                                     //
                       _propulsion_valve_cal_error_msg = _valve_cal_revport_menu;                                //
                       _valve_cal_state_b0_uc = _VALVE_CAL_STATE_FAILED;                                         //
                       break;
1015                }
                    put_ee_propulsion_valve_rev_port_crack_ma_b3_ui ( _valve_cal_current_ma_b3_si );
                    __movement_count_b0_uc = __iteration_count_b0_uc = 0;                                        //
                    _valve_cal_current_ma_b3_si = _valve_cal_start_current_ma_b3_si = current_ma_b3_si( 2800 );  //
                    _valve_cal_tmp_current_ma_b3_si = _cal_default_rev_tank_threshold_current_ma_b3_si;          //
1020                __i_inc_ma_b3_si = -_cal_default_threshold_delta_current_ma_b3_si;                           //
```

PROPULSION.C 23/02/2006 11:22:10

*Fig. 27*

WR, T2, Propulsion Calibration Software

```
                    _valve_cal_state_b0_uc = _valve_cal_state_FWD_05;                                   //
                 break;
                 case __state_offset_b0_ui_4:
                    if(__movement_count_b0_uc == __iteration_count_b0_uc )                              //
                    {
                       fault_log_add_fault( _F427_04 );                                                 //
                       ee_propulsion_valve_rev_tank_crack_ma_b3_ui = 0xfb00;                            //
                       _propulsion_valve_cal_error_msg = _valve_cal_revtank_menu;                       //
                       _valve_cal_state_b0_uc = _VALVE_CAL_STATE_FAILED;                                //
                       break;
                    }
                    if( __movement_count_b0_uc == 0 )                                                   //
                    {
                       fault_log_add_fault( _F427_03 );                                                 //
                       ee_propulsion_valve_rev_tank_crack_ma_b3_ui = 0xfe00;                            //
                       _propulsion_valve_cal_error_msg = _valve_cal_revtank_menu;                       //
                       _valve_cal_state_b0_uc = _VALVE_CAL_STATE_FAILED;                                //
                       break;
                    }
                    put_ee_propulsion_valve_rev_tank_crack_ma_b3_ui ( _valve_cal_current_ma_b3_si );   //
                    Alarm_OneShot_1sec();
                    _valve_cal_state_b0_uc = _VALVE_CAL_STATE_PASSED;                                   //
                 break;
              };
              ++__state_offset_b0_ui;                                                                   //
              break;                                                                                    //
           }

           ++__iteration_count_b0_uc;                                                                   //
     #ifdef CALIBRATE_PROP_VALVE_FOR_100_mL          //mkc2005apr131031
           if( abs( __valve_position_2_b0_si - __valve_position_1_b0_si) > 77  )                        //
     #else
           if( abs( __valve_position_2_b0_si - __valve_position_1_b0_si) > 6  )                         //
     #endif
           {
              ++__movement_count_b0_uc;                                                                 //
              _valve_cal_tmp_current_ma_b3_si -= __i_inc_ma_b3_si;                                     //
           }
           else
              _valve_cal_tmp_current_ma_b3_si += __i_inc_ma_b3_si;                                      //

           _valve_cal_current_ma_b3_si = _valve_cal_start_current_ma_b3_si;                             //
           _valve_cal_state_b0_uc = _valve_cal_state_FWD_05;                                            //
        break;

        case _valve_cal_state_FWD_05:                                                                   //
           if( ++__timer01 >= _time_b0_ui2scans_sec_f(5.00) )                                           //
           {
              __timer01=0;                                                                              //
              __valve_position_sum_b0_sl=0;                                                             //
```

PROPULSION.C 23/02/2006 11:22:10

*Fig. 28*

WR, T2, Propulsion Calibration Software

```
                _valve_cal_state_b0_uc = _valve_cal_state_FWD_06;                    //
            }
            if( !(__timer01%_time_b0_ui2scans_sec_f(1.00)) )                         //
            {
                __valve_position_1_b0_si =                                           //
                (
                        __valve_position_sum_b0_sl
                    /   _time_b0_ui2scans_sec_f(1.00)
                );
                if( abs( __valve_position_2_b0_si - __valve_position_1_b0_si) <    5  )   //
                {
                    __timer01=0;                                                     //
                    _valve_cal_current_ma_b3_si =  _valve_cal_tmp_current_ma_b3_si;  //
                    _valve_cal_state_b0_uc = _valve_cal_state_FWD_07;                //
                }
                else
                {
                    __valve_position_2_b0_si = __valve_position_1_b0_si;
                    __valve_position_sum_b0_sl=0;                                    //
                }
            }
            else
            {
                __valve_position_sum_b0_sl +=                                        //
                (
                    iomap_anin_R02_FNR_lever_pot_OR_R23_steeringshaft_pot_A.raw
                );
            }
        break;
        case _valve_cal_state_FWD_06:                                                //
            if( ++__timer01 > _time_b0_ui2scans_sec_f(1.00) )                        //
            {
                __timer01=0;                                                         //
                __valve_position_1_b0_si =                                           //
                (
                        __valve_position_sum_b0_sl
                    /   _time_b0_ui2scans_sec_f(1.00)
                );
                _valve_cal_current_ma_b3_si =  _valve_cal_tmp_current_ma_b3_si;      //
                _valve_cal_state_b0_uc = _valve_cal_state_FWD_07;                    //
            }
            else
            {
                __valve_position_sum_b0_sl +=                                        //
                (
                    iomap_anin_R02_FNR_lever_pot_OR_R23_steeringshaft_pot_A.raw
                );
            }
        break;
```

PROPULSION.C 23/02/2006 11:22:10

*Fig. 29*

WR, T2, Propulsion Calibration Software

```
            case _valve_cal_state_FWD_07:                                                    //
               if( ++__timer01 >= _time_b0_ui2scans_sec_f(5.00) )                            //
               {
                  __timer01=0;                                                               //
                  __valve_position_sum_b0_sl=0;                                              //
                  _valve_cal_state_b0_uc = _valve_cal_state_FWD_08;                          //
               }
            break;

            case _valve_cal_state_FWD_08:                                                    //
               if( ++__timer01 >= _time_b0_ui2scans_sec_f(1.00) )                            //
               {
                  __timer01=0;                                                               //
                  __valve_position_2_b0_si =                                                 //
                  {
                        __valve_position_sum_b0_sl
                     /  _time_b0_ui2scans_sec_f(1.00)
                  };
                  _valve_cal_state_b0_uc = _valve_cal_state_FWD_04;                          //
               }
               else
               {
                  __valve_position_sum_b0_sl +=                                              //
                  {
                     iomap_anin_R02_FNR_lever_pot_OR_R23_steeringshaft_pot_A.raw
                  };
               }
            break;

            case _VALVE_CAL_STATE_BEGIN_03:

            case _VALVE_CAL_STATE_PASSED:
               _valve_cal_current_ma_b3_si = 0;
               //Show some message here to indicate a successful calibration!
               _propulsion_valve_cal_msg = _cal_success_menu;
               if( ++_timer02_ui >= _initwait )
               {
                  _timer02_ui = 0;
                  _valve_cal_state_b0_uc = _valve_cal_state_SET_NEUT_CAL_MSG;
               }
            break;

            case _VALVE_CAL_STATE_FAILED:
               _valve_cal_current_ma_b3_si = 0;
               //Lock out propulsion since calibration failed
               //Propulsion will be locked out at subsequent starts until the ee validation passes
               propulsion_ESTOP_state_machine_start();
               //Indicate failure with beep
               Alarm_OneShot_1sec();
               //Show some message here to indicate a failed calibration!
               _propulsion_valve_cal_msg = _cal_failed_menu;
```

PROPULSION.C 23/02/2006 11:22:10

*Fig. 30*

WR. T2. Propulsion Calibration Software

```
                if( ++_timer02_ui >= _initwait )
                {
                   _timer02_ui = 0;
                   _valve_cal_state_b0_uc = _VALVE_CAL_STATE_FAILURE_MESSAGE;
                }
             break;

             case _VALVE_CAL_STATE_FAILURE_MESSAGE:
                _propulsion_valve_cal_msg = _propulsion_valve_cal_error_msg;
                if( ++_timer02_ui >= _initwait )
                {
                   _timer02_ui=0;
                   _valve_cal_state_b0_uc = _VALVE_CAL_STATE_EXIT;
                }
             break;

             case _VALVE_CAL_STATE_CHECK_CONFIG:
                _valve_cal_current_ma_b3_si = 0;
                _propulsion_valve_cal_msg = _cal_check_config_menu;
                if( ++_timer02_ui >= _initwait )
                {
                   _timer02_ui=0;
                   _valve_cal_state_b0_uc = _VALVE_CAL_STATE_EXIT;
                }
             break;

             case _VALVE_CAL_STATE_EXIT:
                _propulsion_valve_cal_msg = _cal_ended_key_off;
                if(++_timer02_ui >= _initwait )
                {
                   _timer02_ui=0;

                   //Exit the function through this state
                   //menu_change_focus( _calibrations_menu );
                   //_valve_cal_state_b0_uc = _VALVE_CAL_STATE_INIT;
                }
             break;

             case _valve_cal_state_SET_NEUT_CAL_MSG:
                //tell the operator to set neutral cal after key off
                _propulsion_valve_cal_msg = _set_neutral_cal_msg_menu;
                if( ++_timer02_ui >= _initwait )
                {
                   _timer02_ui = 0;
                   _valve_cal_state_b0_uc = _VALVE_CAL_STATE_EXIT;
                }
             break;
          }

          if( __update_display_flag_b0_uc == 1 )
          {
```

*Fig. 31*

PROPULSION.C 23/02/2006 11:22:10

WR, T2, Propulsion Calibration Software

```
        menu_change_focus( _propulsion_valve_cal_msg, _type_menu_e );  //Pass message pointer to display handler on
        __update_display_flag_b0_uc=0;
      }

      if( _valve_cal_state_b0_uc != _prev_valve_cal_state_b0_uc )
        __update_display_flag_b0_uc=1;

      _interactive_cal_proceed_flag_b0_uc = 0;   //jpeters2004Apr201201  Default calibration proceed flag to zero
      _prev_valve_cal_state_b0_uc = _valve_cal_state_b0_uc;

      propulsion_Icntrl_setpt( _valve_cal_current_ma_b3_si );
      //propulsion_Icntrl_main();  //jpeters2004May241418 Moved to kernel operations
      DispPID_main(0);

     //CAN_test_data2[0].word = EE_steering_shaft_primary_extended_v_b11_si;
     //CAN_test_data2[1].word = EE_steering_shaft_primary_retracted_v_b11_si;
     //CAN_test_data2[2].word = EE_steering_shaft_primary_neutral_v_b11_si;
     //CAN_test_data[0].byte.lo = _valve_cal_state_b0_uc;
     //CAN_test_data[0].byte.hi = ( Gnd_speed_b3x10.filtered / BIN3 );
     //CAN_test_data[1].word = _valve_cal_current_ma_b3_si;
     //CAN_test_data[2].word = iomap_anin_R02_FNR_lever_pot_OR_R23_steeringshaft_pot_A.raw;
     //CAN_test_data[3].word = ( propulsion_valve_L15_rev_current_ma_b3_si() - propulsion_valve_L14_fwd_current_ma_b
     //CAN_test_data2[0].word = EE_propulsion_valve_fwd_port_crack_ma_b3_si;
     //CAN_test_data2[1].word = EE_propulsion_valve_fwd_tank_crack_ma_b3_si;
     //CAN_test_data2[2].word = EE_propulsion_valve_rev_port_crack_ma_b3_si;
     //CAN_test_data2[3].word = EE_propulsion_valve_rev_tank_crack_ma_b3_si;

    }


/*****************************************************************************/
void propulsion_valve_calibration_entry( void )
{
   _valve_cal_state_b0_uc = _VALVE_CAL_STATE_ENTRY;
   main_request_engine_running_cal();
}


/*************************************************************************/
void  propulsion_valve_goto_calibration( void )
{
   _valve_cal_state_b0_uc = _VALVE_CAL_STATE_BEGIN;
}


/*****************************************************************************/
void propulsion_valve_calibration_proceed( void )
{
   _interactive_cal_proceed_flag_b0_uc = 1;
}
```

*Fig. 32*

PROPULSION.C 23/02/2006 11:22:10

```
/*****************************************************************************/
void propulsion_valve_calibration_exit( void )
{
   _valve_cal_state_b0_uc = _VALVE_CAL_STATE_FAILED;
   _propulsion_valve_cal_error_msg = _cal_failed_menu;
}


//*************************************************************
void  propulsion_input_wiggle( void )
{
   static signed int    __b01_left_gnd_speed_sensor_v_b11_si;
   static signed int    __b01_previous_left_gnd_speed_sensor_v_b11_si;
   static signed int    __b03_right_gnd_speed_sensor_v_b11_si;
   static signed int    __b03_previous_right_gnd_speed_sensor_v_b11_si;
   static signed int    __r02_fnr_lever_position_v_b11_si;
   static signed int    __r02_previous_fnr_lever_pos_v_b11_si;
   static signed int    __r18_fnr_handle_position_v_b11_si;
   static signed int    __r18_previous_fnr_handle_pos_v_b11_si;
   static signed int    __r21_pintle_arm_position_v_b11_si;
   static signed int    __r21_previous_pintle_arm_pos_v_b11_si;
   static signed int    __r23A_prop_cylinder_position_v_b11_si;
   static signed int    __r23A_previous_prop_cylinder_pos_v_b11_si;
   static signed int    __r23B_prop_cylinder_position_v_b11_si;
   static signed int    __r23B_previous_prop_cylinder_pos_v_b11_si;

   #define  __sensor_state_init                    0
   #define  __sensor_state_check_for_change        1

   #define  __voltage_limit_v_b11_si      volts_v_b11_si( 0.05 )     //50mv initially

   //get present voltage of speed sensors and pots
   __b01_left_gnd_speed_sensor_v_b11_si = _B01_AtoD_b0_ui_to_v_b11_si_test();
   __b03_right_gnd_speed_sensor_v_b11_si = _B03_AtoD_b0_ui_to_v_b11_si_test();
   __r02_fnr_lever_position_v_b11_si = (signed int)R02_AtoD_b0_ui_to_v_b11_ui();
   __r18_fnr_handle_position_v_b11_si = (signed int)mfh_R18_v_b11_ui_w_errors_returned();
   __r21_pintle_arm_position_v_b11_si = (signed int)R21_raw_AtoD_b0_ui_to_v_b11_ui();
   __r23A_prop_cylinder_position_v_b11_si = (signed int)R23A_AtoD_b0_ui_to_v_b11_ui();
   __r23B_prop_cylinder_position_v_b11_si = (signed int)R23B_AtoD_b0_ui_to_v_b11_ui();

   switch( _sensor_wiggle_state_b0_uc )
   {
      case  __sensor_state_init:
         __b01_previous_left_gnd_speed_sensor_v_b11_si = __b01_left_gnd_speed_sensor_v_b11_si;
         __b03_previous_right_gnd_speed_sensor_v_b11_si = __b03_right_gnd_speed_sensor_v_b11_si;
         __r02_previous_fnr_lever_pos_v_b11_si = __r02_fnr_lever_position_v_b11_si;
         __r18_previous_fnr_handle_pos_v_b11_si = __r18_fnr_handle_position_v_b11_si;
         __r21_previous_pintle_arm_pos_v_b11_si = __r21_pintle_arm_position_v_b11_si;
         __r23A_previous_prop_cylinder_pos_v_b11_si = __r23A_prop_cylinder_position_v_b11_si;
         __r23B_previous_prop_cylinder_pos_v_b11_si = __r23B_prop_cylinder_position_v_b11_si;
```

*Fig. 33*

WR, T2, Propulsion Calibration Software

```
            _sensor_wiggle_state_b0_uc = __sensor_state_check_for_change;
1330      break;
          case  __sensor_state_check_for_change:
            //check for voltage change in left ground speed sensor
1335          if
              {
                ( ( __b01_left_gnd_speed_sensor_v_b11_si - __b01_previous_left_gnd_speed_sensor_v_b11_si ) >= __vo
                ||
                ( ( __b01_previous_left_gnd_speed_sensor_v_b11_si - __b01_left_gnd_speed_sensor_v_b11_si ) >= __vo
1340          }
                wig_test_add_input( wig_test_b_01_obj_idx );
            //check for voltage change in right ground speed sensor
              if
1345          {
                ( ( __b03_right_gnd_speed_sensor_v_b11_si - __b03_previous_right_gnd_speed_sensor_v_b11_si ) >= __
                ||
                ( ( __b03_previous_right_gnd_speed_sensor_v_b11_si - __b03_right_gnd_speed_sensor_v_b11_si ) >= __
              }
1350            wig_test_add_input( wig_test_b_03_obj_idx );
            //check for voltage change in fnr handle position pot (deluxe model)
              if
              {
1355            ( ( __r18_fnr_handle_position_v_b11_si - __r18_previous_fnr_handle_pos_v_b11_si ) >= __voltage_lim
                ||
                ( ( __r18_previous_fnr_handle_pos_v_b11_si - __r18_fnr_handle_position_v_b11_si ) >= __voltage_lim
              }
                wig_test_add_input( wig_test_r_18_obj_idx );
1360
            //check for voltage change in pintle arm position pot
              if
              {
                ( ( __r21_pintle_arm_position_v_b11_si - __r21_previous_pintle_arm_pos_v_b11_si ) >= __voltage_lim
1365            ||
                ( ( __r21_previous_pintle_arm_pos_v_b11_si - __r21_pintle_arm_position_v_b11_si ) >= __voltage_lim
              }
                wig_test_add_input( wig_test_r_21_obj_idx );
1370        if( economy_model_b_xp )                                  // this is for the economy model
            {
              //check for voltage change in fnr lever position pot (economy model)
              if
              {
1375            ( ( __r02_fnr_lever_position_v_b11_si - __r02_previous_fnr_lever_pos_v_b11_si ) >= __voltage_limit
                ||
                ( ( __r02_previous_fnr_lever_pos_v_b11_si - __r02_fnr_lever_position_v_b11_si ) >= __voltage_limit
```

PROPULSION.C 23/02/2006 11:22:10

*Fig. 34*

WR, T2, Propulsion Calibration Software

```
                )
                   wig_test_add_input( wig_test_r_02_obj_idx );
1380          }
              else
              {
                //check for voltage change in propulsion cylinder position pot A
                if
1385            (
                   ( ( __r23A_prop_cylinder_position_v_b11_si - __r23A_previous_prop_cylinder_pos_v_b11_si ) >= __vol
                   ||
                   ( ( __r23A_previous_prop_cylinder_pos_v_b11_si - __r23A_prop_cylinder_position_v_b11_si ) >= __vol
                )
1390               wig_test_add_input( wig_test_r_23_a_obj_idx );

                //check for voltage change in propulsion cylinder position pot A
                if
                (
1395               ( ( __r23B_prop_cylinder_position_v_b11_si - __r23B_previous_prop_cylinder_pos_v_b11_si ) >= __vol
                   ||
                   ( ( __r23B_previous_prop_cylinder_pos_v_b11_si - __r23B_prop_cylinder_position_v_b11_si ) >= __vol
                )
                   wig_test_add_input( wig_test_r_23_b_obj_idx );
1400          }

              //refresh previous
                __b01_previous_left_gnd_speed_sensor_v_b11_si = __b01_left_gnd_speed_sensor_v_b11_si;
                __b03_previous_right_gnd_speed_sensor_v_b11_si = __b03_right_gnd_speed_sensor_v_b11_si;
1405            __r02_previous_fnr_lever_pos_v_b11_si = __r02_fnr_lever_position_v_b11_si;
                __r18_previous_fnr_handle_pos_v_b11_si = __r18_fnr_handle_position_v_b11_si;
                __r21_previous_pintle_arm_pos_v_b11_si = __r21_pintle_arm_position_v_b11_si;
                __r23A_previous_prop_cylinder_pos_v_b11_si = __r23A_prop_cylinder_position_v_b11_si;
                __r23B_previous_prop_cylinder_pos_v_b11_si = __r23B_prop_cylinder_position_v_b11_si;
1410
           break;

           default:
              _sensor_wiggle_state_b0_uc = __sensor_state_init;
1415
           break;
        }

        //check fnr neutral switch
1420       if
           (     iomap_digin_swstate_S03_fnr_neutral.lh
              || iomap_digin_swstate_S03_fnr_neutral.hl
           )
              wig_test_add_input( wig_test_s_03_obj_idx );
1425
        //check high ground speed switch
           if
           (     iomap_digin_swstate_S11_hi_gnd_speed.lh
```

PROPULSION.C 23/02/2006 11:22:10

*Fig. 35*

WR, T2, Propulsion Calibration Software

```
            || iomap_digin_swstate_S11_hi_gnd_speed.hl
      )
         wig_test_add_input( wig_test_s_11_obj_idx );

   //check park brake on manually switch
      if
      (     iomap_digin_swstate_S28_park_brake_on_manually.lh
         || iomap_digin_swstate_S28_park_brake_on_manually.hl
      )
         wig_test_add_input( wig_test_s_28_on_manually_obj_idx );

   //check field cruise switch
      if
      (     iomap_digin_swstate_S23_field_cruise.lh
         || iomap_digin_swstate_S23_field_cruise.hl
      )
         wig_test_add_input( wig_test_s_23_field_obj_idx );

   //check park brake release switch
      if
      (     iomap_digin_swstate_S28_park_brake_release.lh
         || iomap_digin_swstate_S28_park_brake_release.hl
      )
         wig_test_add_input( wig_test_s_28_obj_idx );
}

/*********************************************************************/
static void _propulsion_shaft_neutral_cal( void )
{
   static const void*   _shaft_cal_msg;
   static unsigned char __update_display_flag_b0_uc;
   static unsigned int  __entry_timer;


   switch( _shaft_neutral_cal_state_b0_uc )
   {
      case  _PROP_SHAFT_NEUT_CAL_STATE_INIT:

         __entry_timer = 0;

      return;

      case  _PROP_SHAFT_NEUT_CAL_STATE_ENTRY:

         _shaft_cal_msg = _read_service_manual_menu;                    //display "Read Service Manual" messag
         __entry_timer = 0;
         _shaft_neutral_cal_state_b0_uc = _PROP_SHAFT_NEUT_CAL_STATE_ENTRY_TIME_LIMIT;

      break;
```

PROPULSION.C 23/02/2006 11:22:10

*Fig. 36*

WR, T2, Propulsion Calibration Software

```
1480        case  _PROP_SHAFT_NEUT_CAL_STATE_ENTRY_TIME_LIMIT:

               if( ++__entry_timer >= _time_b0_ui2scans_sec_f( 3.0 ) )          //3 second maximum time allowed
               {
                  __entry_timer = 0;
1485              _shaft_neutral_cal_state_b0_uc = _PROP_SHAFT_NEUT_CAL_STATE_FAILED;
               }

               if( rt_trim_incr_lh )                                            //right trim increase switch presse
               {
1490              __entry_timer = 0;                                            //reset entry timer
                  Alarm_RapidMod_5sec();                                        //give a 5 secs with rapid modulati
                  _shaft_neutral_cal_state_b0_uc = _PROP_SHAFT_NEUT_CAL_STATE_ENTRY_WARNING_MSG;   //go to next state
               }

1495        break;

            case  _PROP_SHAFT_NEUT_CAL_STATE_ENTRY_WARNING_MSG:

               if(economy_model_b_xp)
1500              _shaft_cal_msg = _prop_shaft_neutral_cal_econo_entry_warning_msg_menu;  //display entry warning messa
               else
                  _shaft_cal_msg = _prop_shaft_neutral_cal_entry_warning_msg_menu;        //display entry warning messa

            break;
1505
            case _PROP_SHAFT_NEUT_CAL_STATE_BEGIN_R_02:

               _shaft_cal_msg = _r_02_cal_menu;

1510        break;

            case _PROP_SHAFT_NEUT_CAL_STATE_BEGIN_R_23A:

               _shaft_cal_msg = _r_23_a_cal_menu;
1515
            break;

            case _PROP_SHAFT_NEUT_CAL_STATE_BEGIN_R_23B:

1520           _shaft_cal_msg = _r_23_b_cal_menu;

            break;

            case _PROP_SHAFT_NEUT_CAL_STATE_FAILED:
1525
               Alarm_OneShot_1sec();                                            //alarm get hit until switch to nex
               _shaft_cal_msg = _cal_failed_menu;
               if( ++__entry_timer >= _time_b0_ui2scans_sec_f( 3.0 ) )          //show calibrations failed for 3 se
               {
1530              __entry_timer = 0;
```

PROPULSION.C 23/02/2006 11:22:10

*Fig. 37*

WR, T2, Propulsion Calibration Software

```
                _shaft_neutral_cal_state_b0_uc = _PROP_SHAFT_NEUT_CAL_STATE_EXIT;
            }
        break;

        case _PROP_SHAFT_NEUT_CAL_STATE_EXIT:

            _shaft_cal_msg = _cal_ended_key_off;

        break;

    }

    if( __update_display_flag_b0_uc == 1 )
    {
        menu_change_focus( _shaft_cal_msg, _type_menu_e ); //Pass message pointer to display handler only on first
        __update_display_flag_b0_uc = 0;
    }

    if( _shaft_neutral_cal_state_b0_uc != _prev_shaft_neutral_cal_state_b0_uc )
        __update_display_flag_b0_uc = 1;

    _prev_shaft_neutral_cal_state_b0_uc = _shaft_neutral_cal_state_b0_uc;

}

/*****************************************************************************/
void propulsion_shaft_neutral_cal_begin_r_02( void )
{
    _shaft_neutral_cal_state_b0_uc = _PROP_SHAFT_NEUT_CAL_STATE_BEGIN_R_02;
}


/*****************************************************************************/
void propulsion_shaft_neutral_cal_begin_r_23a( void )
{
    _shaft_neutral_cal_state_b0_uc = _PROP_SHAFT_NEUT_CAL_STATE_BEGIN_R_23A;
}

/*****************************************************************************/
void propulsion_shaft_neutral_cal_begin_r_23b( void )
{
    _shaft_neutral_cal_state_b0_uc = _PROP_SHAFT_NEUT_CAL_STATE_BEGIN_R_23B;
}


/*****************************************************************************/
void propulsion_shaft_neutral_cal_entry( void )
{
    _shaft_neutral_cal_state_b0_uc = _PROP_SHAFT_NEUT_CAL_STATE_ENTRY;
```

PROPULSION.C 23/02/2006 11:22:10

*Fig. 38*

WR_ T2, Propulsion Calibration Software

```
      }

1585 /*****************************************************************************/
     void propulsion_shaft_neutral_cal_exit( void )
     {
        _shaft_neutral_cal_state_b0_uc = _PROP_SHAFT_NEUT_CAL_STATE_FAILED;
     }
1590
```

PROPULSION.C 23/02/2006 11:22:10

*Fig. 39*

VALVE CALIBRATION ROUTINE

This application claims the benefit of U.S. Provisional Application No. 60/777,180, filed Feb. 27, 2006.

TECHNICAL FIELD

The present invention relates to equipment calibration and, more particularly, to a method embodied in a computer program for calibration of a valve, more particularly to calibration of a proportional solenoid valve, and even more particularly to calibration of a proportional solenoid valve used in the propulsion system of an agricultural windrower.

BACKGROUND OF THE INVENTION

U.S. Pat. No. 6,901,729, is incorporated herein by reference in its entirety. This patent describes a windrower. While other embodiments are possible, it is this general type of windrower that provides the best example of the type of system with which the apparatus and method of the instant invention can/should be used. U.S. Provisional Application No. 60/777,180, filed Feb. 27, 2006, is also incorporated herein by reference in its entirety.

In any modern windrower, and much other similar equipment, proportional solenoid controlled valves, activated by electrical currents, are used to control hydraulic devices such as cylinders in the actuation of various systems including the propulsion system. Associated with these valves is a range of current values that causes movement of a movable element of the valve such as a spool or barrel, without creating a path for hydraulic fluid flow between ports. The current value required to move the valve sufficiently to allow fluid communication between ports is referred to as an offset value. An offset of particular interest is the input current required to move the valve to a point in which hydraulic fluid first begins to flow.

It is important to efficient and effective operation of the system to calibrate the valve based on the offset values required to directly activate a proportional valve using electrical current. These offset values can determine the "crack" points between various ports. The "crack" points are the electrical signal levels at which two ports of interest are just beginning to open to one another from a closed position. Of particular interest are the crack points from the supply pressure port to each of the work ports and from the tank port to each of the work ports.

Therefore, it would be desirable to have a method which enables calibration of a valve based on the electrical current offset required to determine the crack points, for instance, those from the supply port to each of the working ports and from the tank port to each of the working ports.

SUMMARY OF THE DISCLOSURE

What is disclosed is an apparatus and method which enables calibration of a proportional solenoid valve activated by electrical current, by determining the crack points from the supply port to the working ports and from the tank port to each of the working ports by automatically deriving the electrical current offsets associated with these crack points.

According to a preferred aspect of the invention, the method utilizes a programmable control module in connection with at least one proportional solenoid valve and a sensor for detection of hydraulic cylinder displacement. The displacement of the moveable element of the hydraulic cylinder is variably controllable as a function of the electrical current signals. The electrical current signals are varied based on an actual displacement of the moveable element of the hydraulic cylinder as compared to a predetermined displacement corresponding to the initial electrical current signal. The current value associated with the offsets can be found by applying levels of input current to the valve and monitoring the hydraulic cylinder for initiation of movement as an indication of fluid flow.

A control module is programmed as part of an automatic calibration routine for directing control signals to the signal controlled device and receiving sensor inputs representative of an actual displacement of the hydraulic cylinders. The solenoid controlling the valve receives test control signals having values which will vary based the actual displacement of the hydraulic cylinder as compared to a predetermined displacement.

According to a preferred aspect of the invention, the signals comprise electrical current values within a range anticipated to encompass the current values required for the displacement of the hydraulic cylinder through its range of displacements. Additionally the sensor provides information representative of displacement of the hydraulic cylinder.

BRIEF DESCRIPTION OF THE DRAWINGS

The advantages of this invention will be apparent upon consideration of the following detailed disclosure of the invention, especially when taken in conjunction with the accompanying drawings wherein:

FIG. 8 is a written listing of steps of the preferred program of the invention;

FIG. 9 is a written listing of still further steps of the preferred program of the invention; and FIG. 10 is a written listing of still further steps of the preferred program of the invention;

FIG. 11 is a written listing of still further steps of the preferred program of the invention;

FIG. 12 is a written listing of still further steps of the preferred program of the invention;

FIG. 13 is a written listing of still further steps of the preferred program of the invention;

FIG. 14 is a written listing of still further steps of the preferred program of the invention;

FIG. 15 is a written listing of still further steps of the preferred program of the invention;

FIG. 16 is a written listing of still further steps of the preferred program of the invention;

FIG. 17 is a written listing of still further steps of the preferred program of the invention;

FIG. 18 is a written listing of still further steps of the preferred program of the invention;

FIG. 19 is a written listing of still further steps of the preferred program of the invention;

FIG. 20 is a written listing of still further steps of the preferred program of the invention;

FIG. 21 is a written listing of still further steps of the preferred program of the invention;

FIG. 22 is a written listing of still further steps of the preferred program of the invention;

FIG. 23 is a written listing of still further steps of the preferred program of the invention;

FIG. 24 is a written listing of still further steps of the preferred program of the invention;

FIG. 25 is a written listing of still further steps of the preferred program of the invention;

FIG. 26 is a written listing of still further steps of the preferred program of the invention;

FIG. 27 is a written listing of still further steps of the preferred program of the invention;

FIG. 28 is a written listing of still further steps of the preferred program of the invention;

FIG. 29 is a written listing of still further steps of the preferred program of the invention;

FIG. 30 is a written listing of still further steps of the preferred program of the invention;

FIG. 31 is a written listing of still further steps of the preferred program of the invention;

FIG. 32 is a written listing of still further steps of the preferred program of the invention;

FIG. 33 is a written listing of still further steps of the preferred program of the invention;

FIG. 34 is a written listing of still further steps of the preferred program of the invention;

FIG. 35 is a written listing of still further steps of the preferred program of the invention;

FIG. 36 is a written listing of still further steps of the preferred program of the invention;

FIG. 37 is a written listing of still further steps of the preferred program of the invention;

FIG. 38 is a written listing of still further steps of the preferred program of the invention; and FIG. 39 is a written listing of still further steps of the preferred program of the invention.

DETAILED DESCRIPTION OF THE PREFERRED EMBODIMENTS

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "left" or "right" is used as a matter of mere convenience, and is determined by standing at the rear of the machine facing in its normal direction of travel. Furthermore, the various components shown or described herein for any specific application of this invention can be varied or altered as anticipated by this invention and the practice of a specific application of any element may already by widely known or used in the art by persons skilled in the art and each will likewise not therefore be discussed in significant detail.

Figure 1:
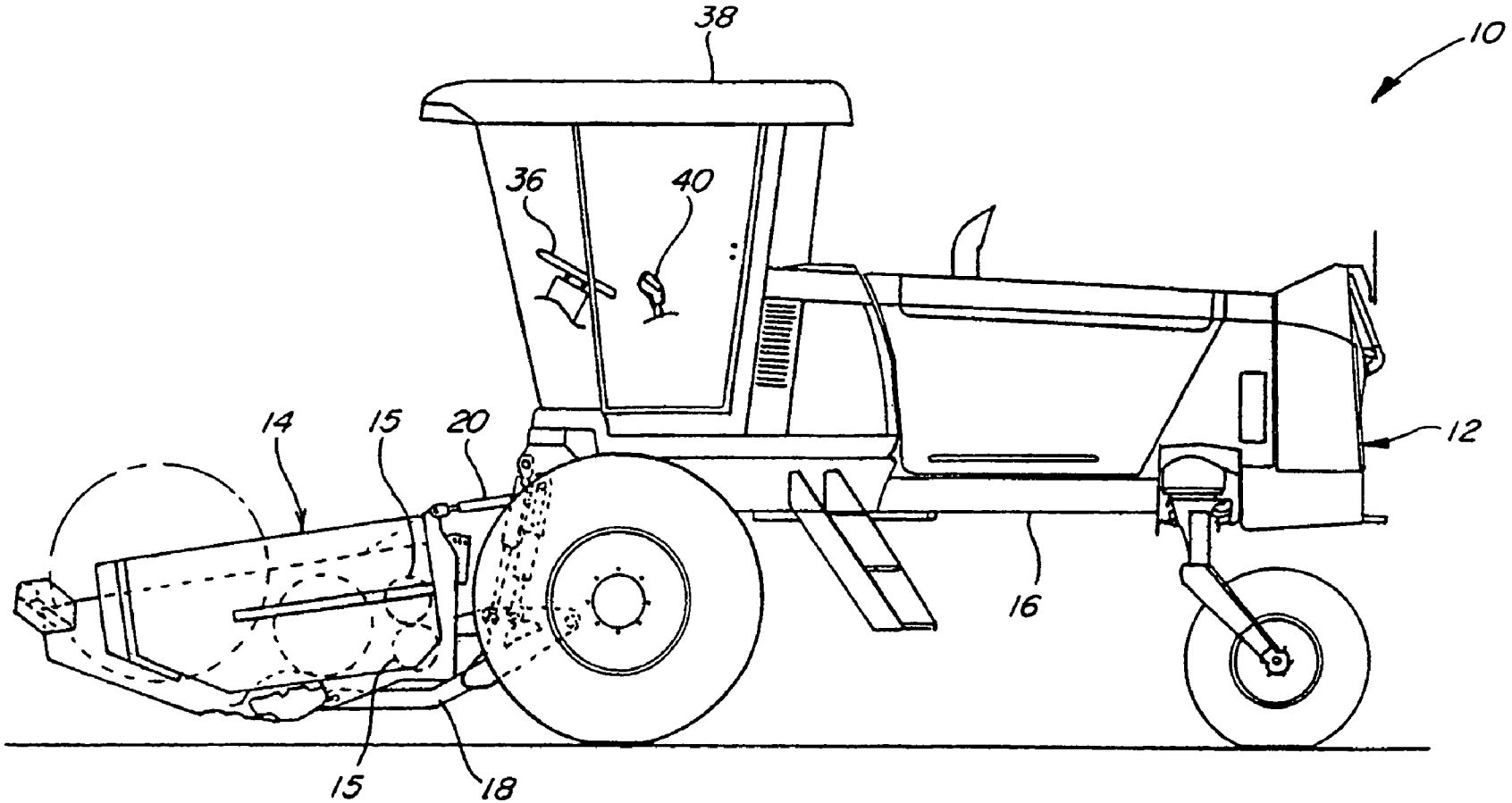
FIG. 1 is a side elevational view of a crop harvesting machine of the type with which the invention may be used.

FIG. 1 shows the present invention utilized in connection with a self-propelled windrower 10; however, it will be appreciated that the principles of the present invention are not limited to a self-propelled windrower, or to any specific type of harvesting machine.

Figure 3:
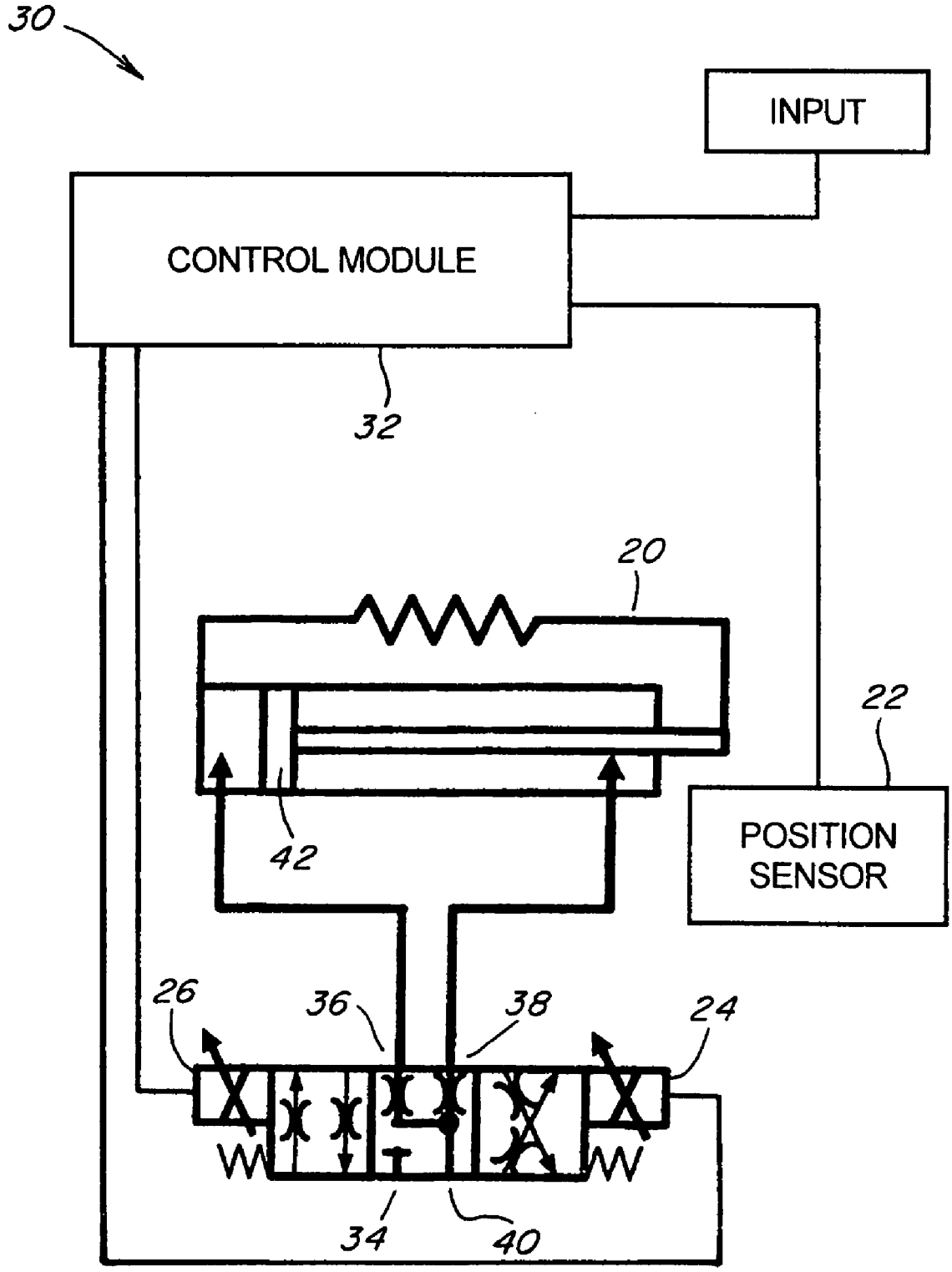
FIG. 3 is a top level block diagram including the interconnections of the invention.

In the illustrated embodiment, the self-propelled windrower 10 comprises a tractor 12 and a header 14 attached to the front end of a frame 18 or chassis of the tractor 12. FIG. 3 shows a top level block diagram 30 of the interconnections of exemplary valve apparatus that can be calibrated using the method embodied in the invention. The method of the present invention describes a routine programmed in a control module 32 that calibrates the input current offsets of a proportional solenoid valve controlled hydraulic actuator as represented by hydraulic actuator 20 which is a common hydraulic cylinder. Application of the input current offsets to a solenoid 24, 26 causes movement in the valve to the point at which two ports are just beginning to open to one another. This offset current can be identified by monitoring a motion or displacement of a moveable element 42 of the actuator 20, which can be, for instance, a piston and rod assembly. A sensor 22 is used to sense cylinder 42 motion and/or position, embodied by motion or displacement of element 42. The offset values to be sensed can be, but are not necessarily limited to:

1. The 'cracking' of a supply pressure port (P) 34 to each of the work ports 36, 38.
2. The 'cracking' of a tank port (T) 40 to each of the work ports 36, 38.

Figure 2:
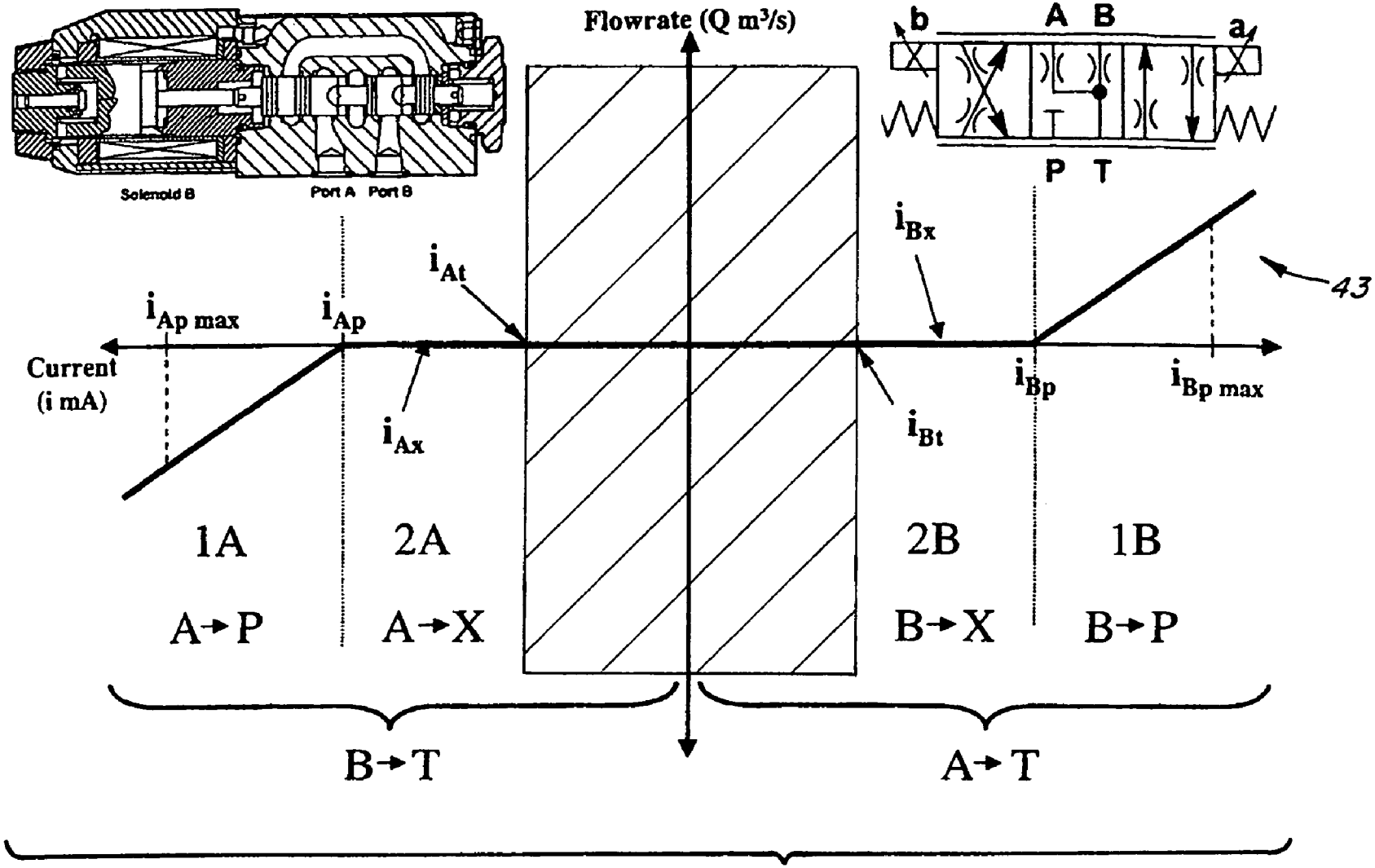
FIG. 2 includes a diagram, schematic and a representative relationship between flow rate and input current for a valve of the type with which the invention may be used.

The 'crack' points are defined as the electrical signal levels at which two ports 34, 36, 38, 40 of interest are just beginning to open to one another from a closed position. The profile 43 of the 'crack' points in relation to hydraulic fluid flow and current applied to solenoid 24, 26 is shown in FIG. 2. Points iAp, iAt, iBp, and iBt can be defined as crack points. A crack point is detected via motion of actuator 20 which is directly correlated to flow. To calibrate a 'cracking' point, a binary divide algorithm is used.

The binary divide routine uses a set of predetermined parameters. These parameters must be defined before execution of the algorithm. These parameters are:

1. Upper limit of electrical signal value (i_ul).
2. Lower limit of electrical signal value (i_ll).
3. Nominal value of electrical signal (i_nom).
4. Dwell time 1 (dt1).
5. Dwell time 2 (dt2).
6. A predetermined distance of cylinder motion (dp).
7. Tolerance on predetermined distance of cylinder motion (dp_tol).
8. Value of electrical signal to be held between stages of calibration (i_null).
9. Number of loops through calibration (n_loops). Other variables used in the algorithm are:
10. High signal history value (i_hh).
11. Low signal history value (i_hl).
12. Electrical test signal value (i_test).
13. initial cylinder position (p_i).
14. Final cylinder position (p_f).
15. Cylinder position difference (dp_diff).
16. Loop counter (count).
17. Number of time cylinder moved (num_mv).
18. Number of times cylinder didn't move (num_nomv).

Noted below is the step by step procedure involved in running a calibration for a single crack point:

Initialization of Binary Divide Algorithm:

Step 1: Set Electrical test signal to nominal value, i_test=i_nom.

Step 2: Set high history value to upper limit of electrical signal value, i_hh=i_ul.

Step 3: Set low history value to lower limit of electrical value, i_hl=i_ll.

Step 4: Set counters to zero, Count=num_mv=num_nomv=0.

Binary Divide Algorithm:

Step 1: Check position of cylinder by averaging sensor value over dt1. Set p_i to this value.

Step 2: Set hardware to the test value, i_test, and hold for dt2.

Step 3: While maintaining electrical signal at i_test, check cylinder position by averaging sensor value over dt1. Set p_f to this value. Set i_test to i_null.

Step 4: Check distance of cylinder motion d by comparing p_i and p_f.

Step 5: Did cylinder move?

If cylinder moved greater than dp, increment num_mv counter. num_mv=num_v+1.

If cylinder moved less than dp, increment num_nomv counter. num_nomv=num_nomv+1.

Increment loop counter, count=count+1.

If loop counter (count) is greater than limit (n_loops), prepare to exit algorithm.

If either num_mv or num_nomv is equal to zero (cylinder either always moved or never moved), Calibration Failed.

Otherwise record and/or return value of i_test and exit algorithm.

Calibration Complete.

Step 6: Determine new value of i_test.

If distance of cylinder motion greater than dp, set next electrical test signal value to: i_test=i_test+(i_hh−i_test)/2.

If distance of cylinder motion greater than dp, set next electrical test signal value to: i_test=i_test−(i_test−i_hl)/2.

Step 7: Check to see if new i_test values are out of bounds.

If i_test>i_ul or i_test<i_ll, then set warning flag and exit calibration.

Calibration Failed.

Step 8: Return to Step 2.

This algorithm is run for each of the defined calibration points. For example the crack points iAp, iAt, iBp, and iBt shown in FIG. 3, the binary divide routine would be run a total of four times. Each of the values 1-8 noted above would have to be redefined for each of the four runs. For the crack to tank calibrations, an external force would have to be applied to the cylinder to force oil flow from the hydraulic cylinder through the valve. One way of doing this is to use a spring centered cylinder and set the cylinder to a position away from the spring centered position at the beginning of the test.

Figure 4:
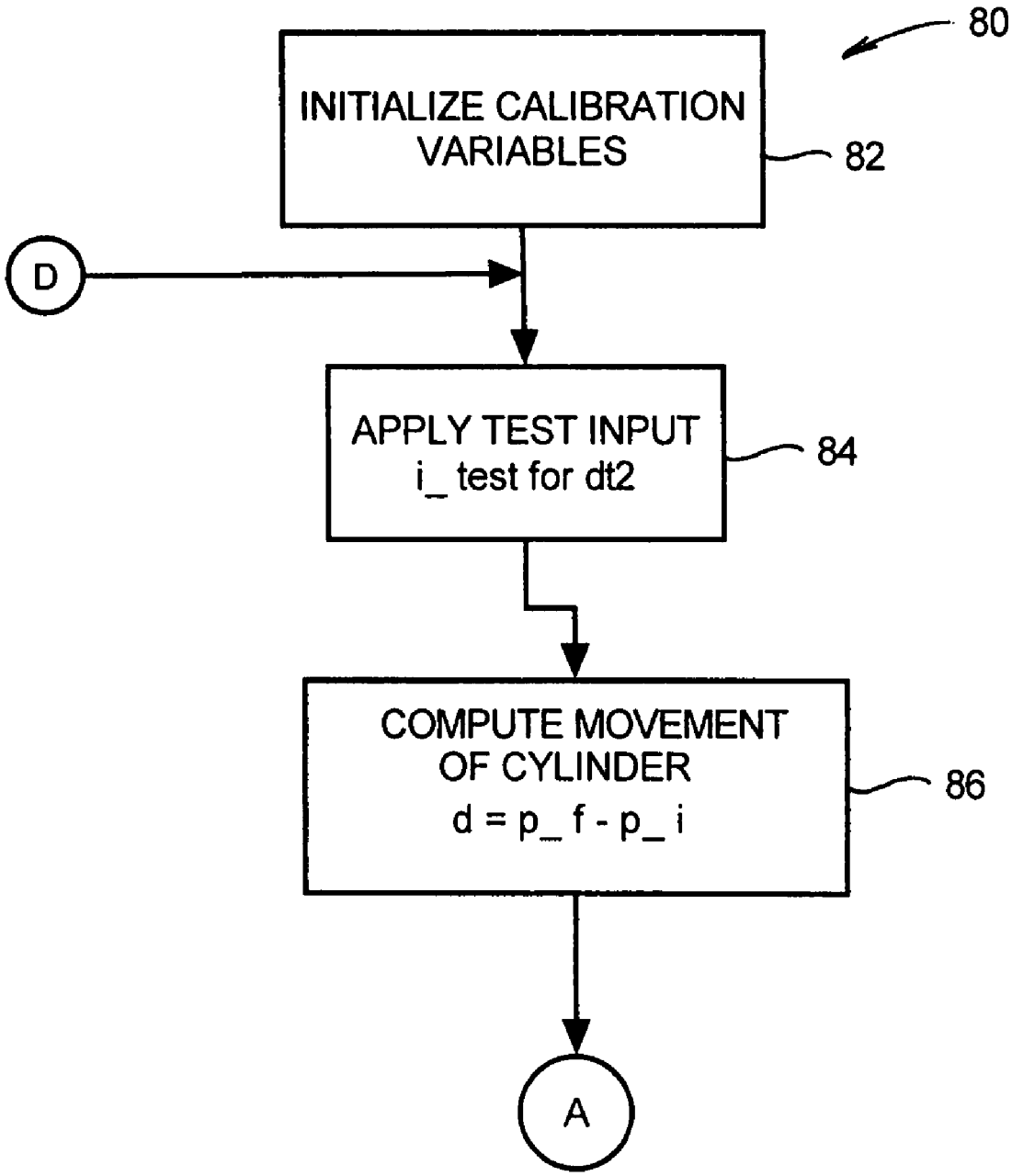
FIG. 4 is a high level flow diagram of steps of a preferred embodiment of a computer program of the invention.

Referring also to FIGS. 4-7, a flow diagram 80 illustrating steps of a method of the instant invention for determining the offset values for control of a proportional solenoid valve operable for controlling movement of element 42 of hydraulic cylinder 20 is shown. The steps of flow diagram 80 are preferably programmed in, and executable by, control module 32 at appropriate times, such as, but not limited to, when changes in the hydraulic system are effected. The calibration routine will be initiated and automatically run in such situations. As shown in FIG. 4, block 82 initiates an offset calibration routine. The variables referenced above are initialized at block 82. At block 84 a current input i_test is applied for a specified duration dt2. The actual responsive movement d of hydraulic cylinder element 42 is computed at block 86 as the final position p_f of cylinder 42 minus the initial position p_i of cylinder 42.

Figure 5:
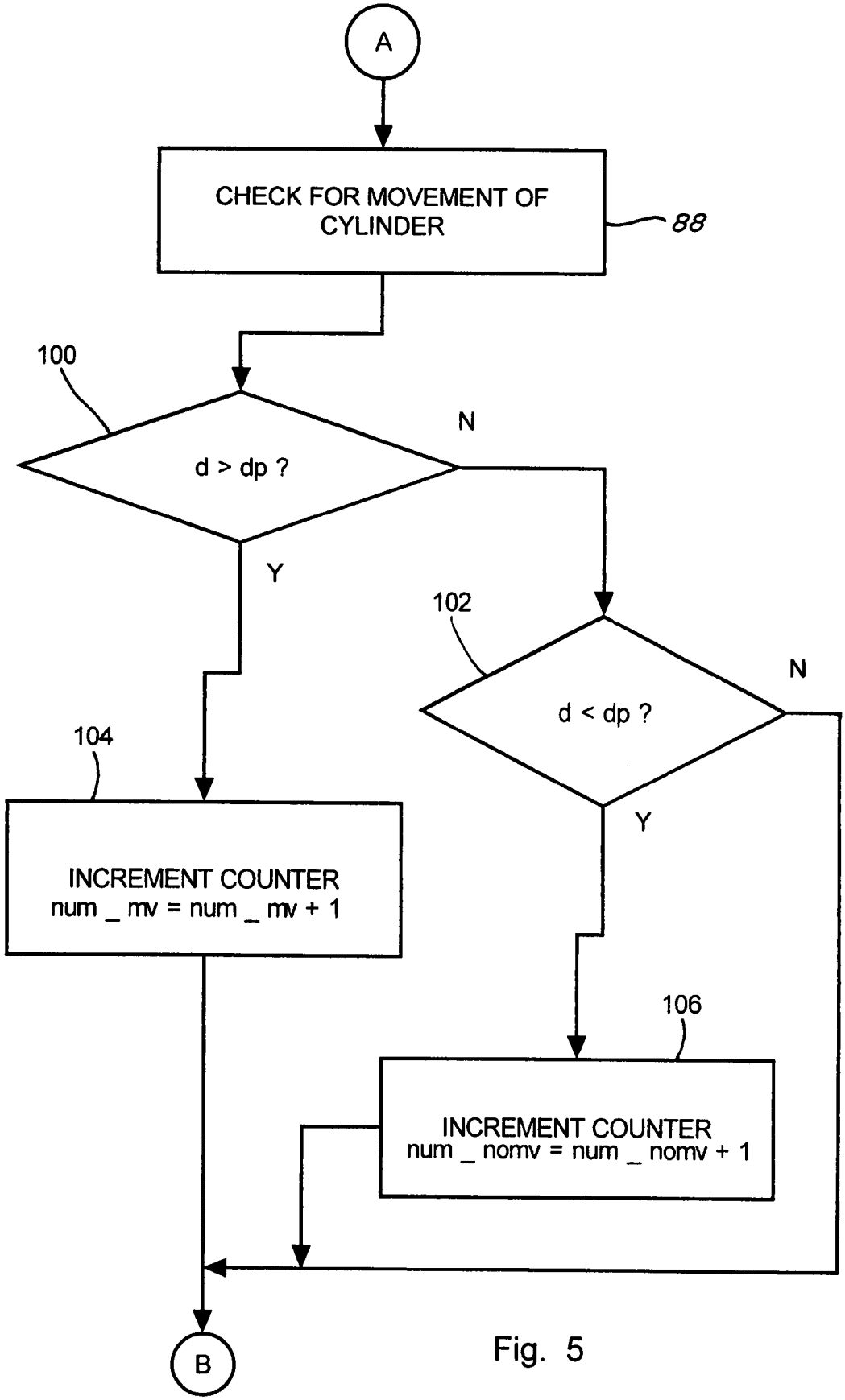
FIG. 5 is another high-level flow diagram of steps of a preferred embodiment of a computer program of the invention.

Following bubble A to FIG. 5 module 32 checks for cylinder 42 movement at block 88. Actual displacement d is compared to a predetermined displacement expected dp in response to the initial input i_test in the step shown in decision blocks 100, 102. If actual displacement d of cylinder 42 exceeds predetermined displacement expected dp in response to the initial input i_test, a counter indicating cylinder element 42 movement, num_mv is incremented at block 104. If actual displacement d of cylinder 42 is less than predetermined displacement expected dp in response to the initial input i_test, a counter indicating a lack of cylinder element 42 movement, num_nomv is incremented at block 106.

Figure 6:
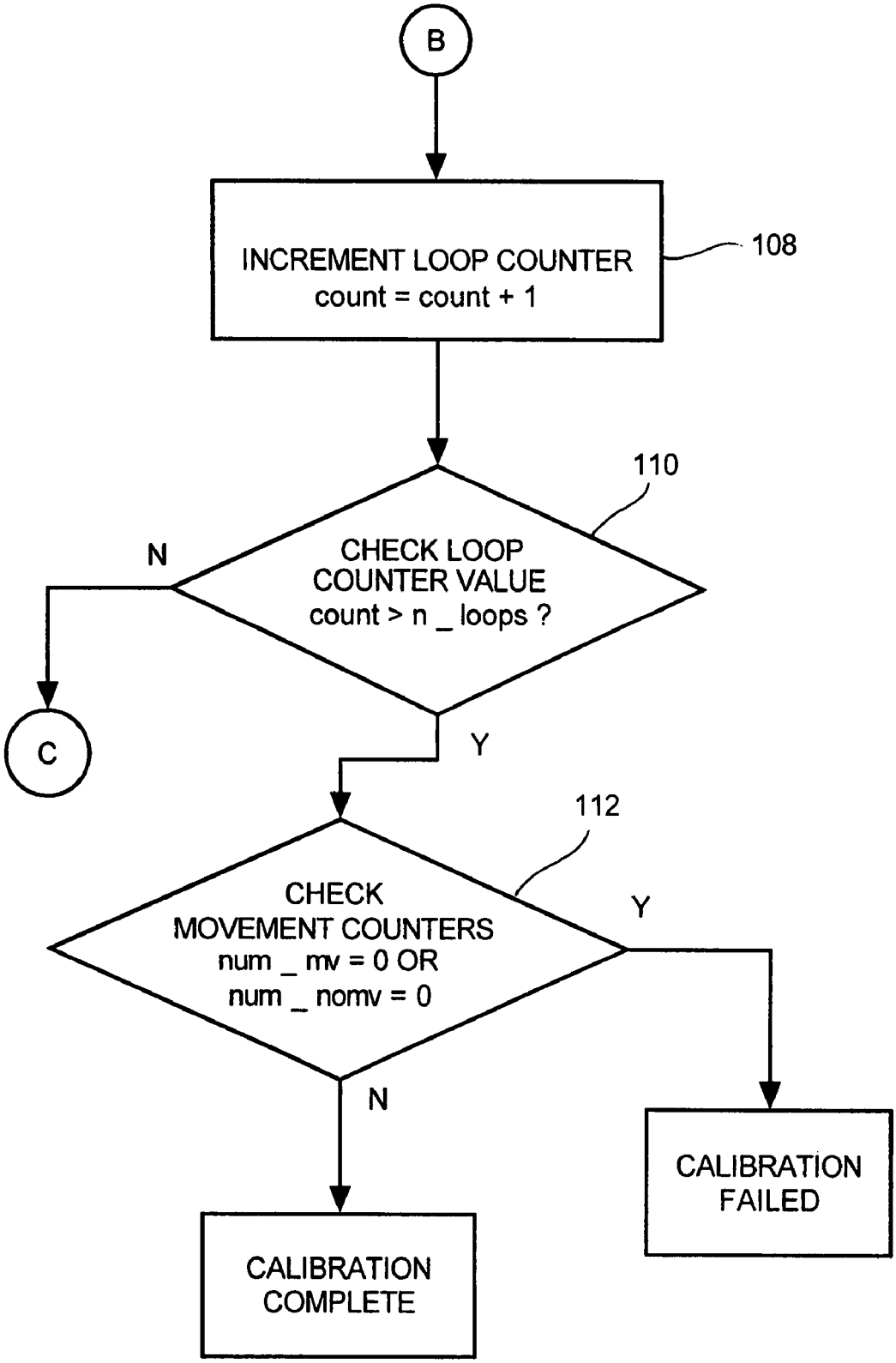
FIG. 6 is another high-level flow diagram of steps of a preferred embodiment of a computer program of the invention.

Following bubble B, a loop counter count is incremented at block 108 as shown in FIG. 6. Count is compared to a predetermined number of times n_loops as shown at block 110. If count has reached n_loops, module 32 compares counters num_mv and num_nomv to zero at decision block 112. If either num_mv or num_nomv are zero, cylinder 42 either moved for every value of i_test or for no value of i_test. Module 32 reports a calibration failure. If num_mv and num_nomv are nonzero, calibration is complete and the value of i_test is noted or stored by module 32. If count has not reached n_loops, a new value of i_test is calculated by following bubble C to FIG. 7 which represents additional steps of module 32.

Figure 7:
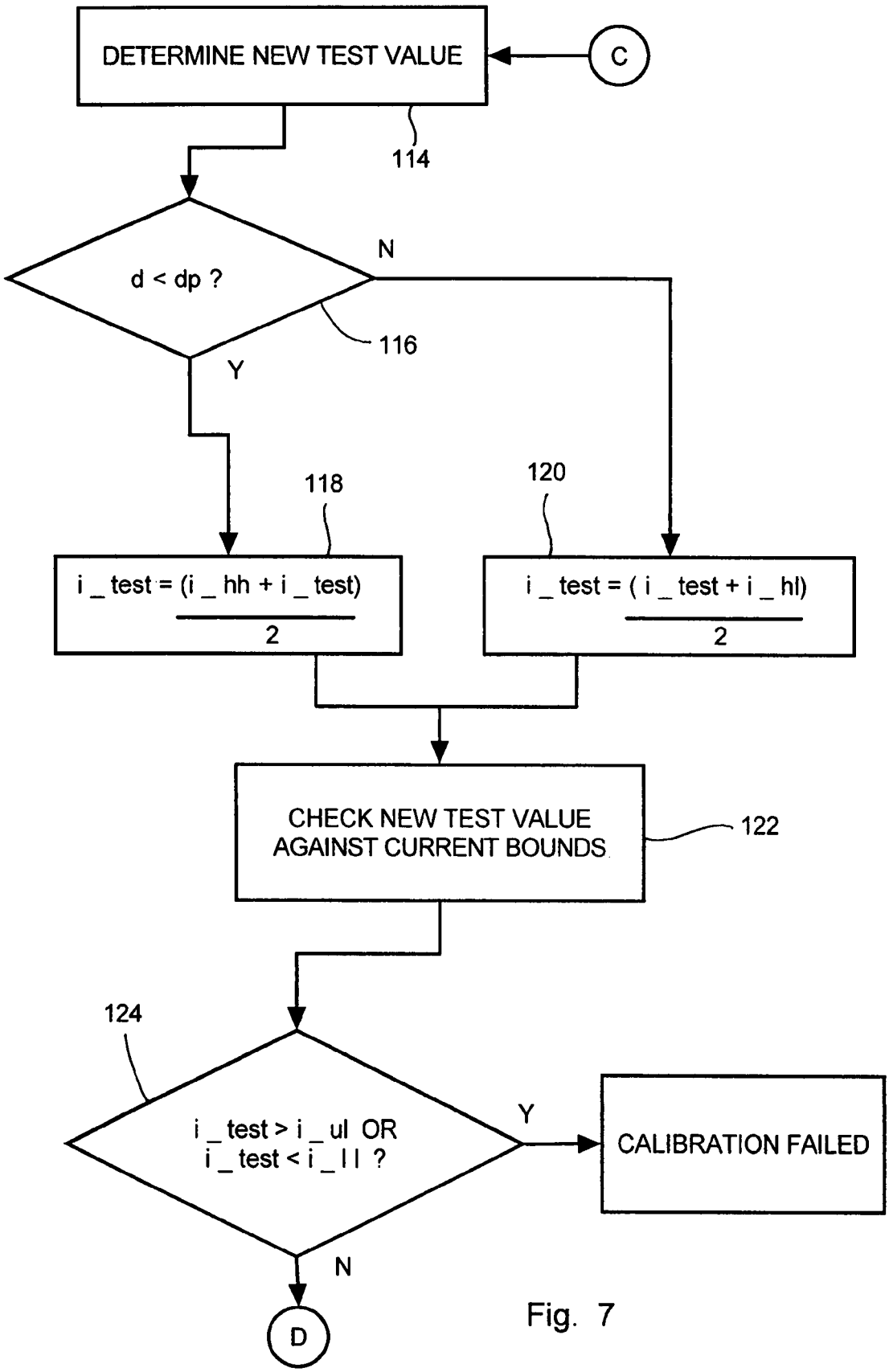
FIG. 7 is another high-level flow diagram of steps of a preferred embodiment of a computer program of the invention.

In FIG. 7 a new value of i_test is calculated as shown at block 114. Decision block 116 compares actual displacement d to predetermined displacement dp. If actual displacement d is less than predetermined displacement dp, i_test is calculated to be a value half way between a previously set high history i_hh value of i_test according to a binary divide algorithm as indicated in block 118. If actual displacement d is not less than predetermined displacement dp, i_test is calculated to be a value half way between a previously set low history i_hl value of i_test according to the binary divide algorithm as indicated in block 120. The high history i_hh is initialized to the current upper limit, and updated with the value i_test when actual displacement d is greater than dp. The low history i_hl is initialized to the current lower limit, and updated with the value i_test when actual displacement d is less than dp. Once the new i_test is calculated, its value is checked against the input current upper limit and lower limit. If the new i_test is outside these limits, the calibration fails. If the new i_test is within these limits, module 32 follows bubble D to repeat application of i_test at block 84 of FIG. 4 with the new i_test.

As a result of execution of the calibration routine of the instant invention, registers of control module 32 will contain information representative of input electrical current values required to be directed to solenoid 24, 26 to determine current values corresponding to crack points such as iAp, iBp, iAt, and iBt.

Referring also to FIGS. 8-39, lines of code of an actual computer program embodying the above described steps of the method of the invention is disclosed. The notes accompanying the lines of code describe many features of the method of the invention.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the inventions. Accordingly, the following claims are intended to protect the invention broadly as well as in the specific form shown.

What is claimed is:

1. A method for calibrating a proportional solenoid valve operable for controlling a device for changing a displacement, comprising steps of:

providing a proportional solenoid controlled valve, the valve including a supply pressure port, at least one work port, and a tank port, the valve being controllably operable responsive to a control signal input for moving through a predetermined range of positions, including a range of positions wherein hydraulic fluid will be directed through the valve between at least the supply pressure port and the at least one work port;

providing a hydraulic cylinder in fluid communication with the at least one work port, the hydraulic cylinder being operable to move an element to various positions within a range of positions responsive to delivery of hydraulic fluid thereto from the at least one work port;

providing a sensor operable for detecting displacements of the element and outputting displacement signals including information representative of detected displacements;

providing a programmable control module in connection with the valve and the sensor, the control module being operable for outputting control signals to the valve and receiving the displacement signals from the sensor; and wherein the control module is programmed for automatically calibrating the control signals, including steps of:

i. outputting a test control signal having a predetermined value to the valve for causing a predetermined displacement of the element, and comparing information representative of an actual displacement caused by the test control signal to information representative of the predetermined displacement;

ii. if the actual displacement is greater than the predetermined displacement, then incrementing a first counter and calculating a new test control signal as an average of the predetermined value of the test control signal and a first predetermined value; and iii. if the actual displacement is less than the predetermined displacement, then incrementing a second counter and calculating a new test control signal as an average of the predetermined value of the test control signal and a second predetermined value, and iv. repeating steps i through iii a predetermined number of times;

storing the value for the test control signal; and operating the hydraulic cylinder using the stored value for determining displacements of the element.

2. The method of claim 1, wherein the control signal values comprise electrical currents.

3. The method of claim 1, wherein the predetermined displacement includes a tolerance range.

4. The method of claim 1, wherein when the actual displacement is less than the predetermined displacement, the new test control signal is calculated as an average of the test value and a historical high test value.

5. The method of claim 4, wherein the historical high test value is initialized to an upper control signal test limit and updated to the value of the test control signal when the actual displacement is greater than the predetermined displacement.

6. The method of claim 1, wherein when the actual displacement is greater than the predetermined displacement, the new test control signal is calculated as an average of the test value and a historical low test value.

7. The method of claim 6, wherein the historical low test value is initialized to a lower control signal test limit and updated to the value of the test control signal when the actual displacement is less than the predetermined displacement.

8. The method of claim 1, wherein the proportional solenoid valve is used in a propulsion system of an agricultural windrower.

9. The method of claim 1, wherein the information representative of the predetermined displacement is related to the position of the element that corresponds to an initiation of hydraulic fluid flow through the valve between the supply pressure port and the at least one work port.

10. The method of claim 1, wherein the information representative of the predetermined displacement is related to the position of the element that corresponds to an initiation of hydraulic fluid flow through the valve between the at least one work port and the tank port.

* * * * *